US007367658B2

(12) United States Patent
Kusunoki et al.

(10) Patent No.: US 7,367,658 B2
(45) Date of Patent: May 6, 2008

(54) INK JET RECORDING APPARATUS

(75) Inventors: Ryutaro Kusunoki, Shizuoka-ken (JP); Tomoka Takanose, Shizuoka-ken (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 236 days.

(21) Appl. No.: 11/357,091

(22) Filed: Feb. 21, 2006

(65) Prior Publication Data

US 2006/0197789 A1 Sep. 7, 2006

(30) Foreign Application Priority Data

Feb. 24, 2005 (JP) ..... P2005-049131

(51) Int. Cl.
*B41J 2/045* (2006.01)

(52) U.S. Cl. ..... 347/68; 347/10; 347/11; 347/12; 347/13; 347/69

(58) Field of Classification Search ..... 347/10–12, 347/56, 68–72
See application file for complete search history.

(56) References Cited

U.S. PATENT DOCUMENTS 5,400,064 A * 3/1995 Pies et al. ..... 347/68
5,444,467 A * 8/1995 Stortz ..... 347/12
5,767,871 A * 6/1998 Imai ..... 347/10
2005/0099452 A1 5/2005 Kusunoki

FOREIGN PATENT DOCUMENTS

JP 2000-255055 9/2000

* cited by examiner

*Primary Examiner*—Lamson Nguyen
*Assistant Examiner*—Justin Seo
(74) *Attorney, Agent, or Firm*—Pillsbury Winthrop Shaw Pittman, LLP

(57) ABSTRACT

An ink jet recording apparatus comprises an ink jet recording head in which a volume of a pressure chamber is caused to vary by deflecting actuators according to drive signals applied between an electrode relative to a pressure chamber from which ink is ejected and actuators relative to two pressure chambers sandwiching the former, and a drive signal generator that generates drive signals for operating the recording head in the four time-divisional drive method. The drive signal generator simultaneously supplies drive signals so that magnitudes of deflections of the outmost actuators 14*f* and 14*i* among four actuators disposed close around the pressure chamber 9*g* from which ink is not to be ejected at a timing when the ink ejection therefrom is enabled in the time divisional driving operation become substantially equal to magnitudes of deflections of the outmost actuators 14*b* and 14*e* among four actuators close around pressure chamber 9*c* from which ink is caused to be ejected, to electrodes relative to the outmost pressure chambers 9*f* and 9*h* among three pressure chambers closely disposed with the center on the pressure chamber 9*g*. Thus, variations in velocity and volume between ink droplets ejected that are caused due to cross-talk between pressure chambers can be reduced.

5 Claims, 20 Drawing Sheets

INK JET RECORDING APPARATUS

CROSS REFERENCE OF THE INVENTION

This application is based upon and claims the benefit of priority from the prior Japanese Patent Application No. 2005-049131 filed on Feb. 24, 2005, the contents of which are incorporated herein by reference.

BACKGROUND OF THE INVENTION

1) Field of the Invention

The present invention relates to an ink jet recording apparatus that ejects ink and records an image on a recording medium, particularly to an ink jet recording apparatus that ejects ink droplets from a nozzle communicating with a pressure chamber by driving actuators of side walls partitioning the respective pressure chambers to cause the actuators to deflect so as to vary a volume of the pressure chamber.

2) Description of Related Art

A so-called "shared-wall type recording head," i.e. a recording head having side walls constituted by actuators of such as piezoelectric members that isolate the respective pressure chambers, includes a problem of cross-talk that occurs by deflection of an actuator through propagation of a pressure change via a neighboring chamber produced within one pressure chamber and adversely changes velocities and volumes of ink droplets that are ejected to form an image. A Japanese patent application publication number 2000-255055 describes a method of driving an ink jet recording head of compensating the adverse deviation of velocity of an ink droplet that is ejected by cross-talk by creating a pressure fluctuation within a pressure chamber that is operated not to eject ink.

However, this method of ink jet recording could not sufficiently reduce the variations in ink ejection velocity and volume due to the cross-talk between pressure chambers, although the method improves them at a certain degree, because the pressure fluctuation creating a counter cross-talk that compensates the variation of the ink ejection velocity is limited to such a degree that an ink cannot be ejected.

SUMMARY OF THE INVENTION

In view of the above problem, the present invention provides an ink jet recording apparatus that can reduce variations in velocity and volume of an ink that appear depending on different recording patterns by sufficiently reducing variations in velocity and volume of an ink droplet due to cross-talk between pressure chambers, and thus improve quality of ink jet recording.

The present invention in one preferable embodiment provides an ink jet recording apparatus that comprises: an ink jet recording head having a plurality of nozzles ejecting ink, a plurality of pressure chambers communicating with the respective nozzles, ink supplying means for supplying ink to the respective pressure chambers, a plurality of electrodes provided relative to the respective pressure chambers, and actuators that form side walls isolating the respective pressure chambers and are caused to deflect so as to vary a volume of the pressure chamber from which ink is to be ejected according to drive signals, which are applied between one electrode relative to a pressure chamber from which ink is ejected and the two electrodes relative to the two pressure chambers adjacent to the former; and drive signal generating means for generating drive signals that enables time-divisional driving so that ink droplets are concurrently ejected from every N chambers, where N=2M M≧2), and supplying the drive signals to electrodes relative to the respective chambers, wherein said drive signal generating means supplies to an electrode relative to the outmost chambers among (N−1) chambers closely disposed with the center on a chamber from which ink is made not to be ejected at a timing when the ink ejection is enabled in the time-divisional driving operation, such drive signals that magnitudes deflections of the outmost actuators among N actuators disposed close around a pressure chamber from which ink is made not to be ejected at a timing when the ink ejection is enabled in the time-divisional driving operation are made substantially to conform to magnitudes of deflections of the outmost actuators among N actuators disposed close around a pressure chamber from which ink is made to be ejected.

DESCRIPTION OF THE PREFERRED EMBODIMENTS

Figure 1:
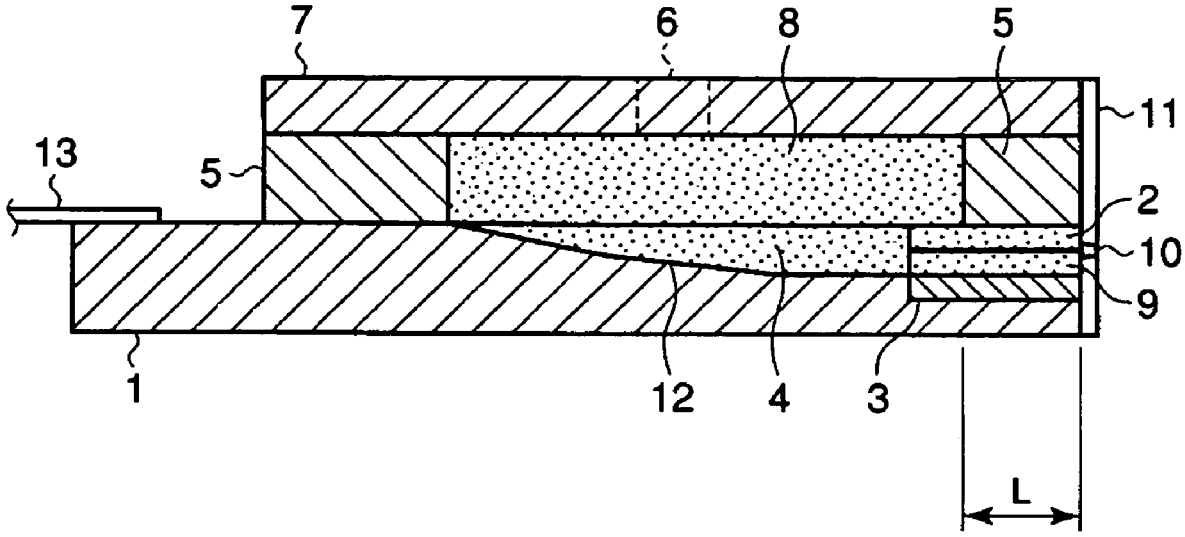
FIG. 1 is a longitudinal cross sectional view showing a whole structure of an ink jet recording head according to one embodiment of the present invention.

One embodiment according to the present invention will be described in reference to the accompanying drawings, in which like reference numerals denote like structures.

A structure of an ink jet recording head used in this embodiment is now described. FIG. 1 is a longitudinal cross sectional view illustrating a whole structure of an ink jet recording head. As shown in the FIGURE, in the fore-end of a substrate 1 of a low dielectric constant there are embedded two piezoelectric members being glued together such that the respective polarization directions of two piezoelectric members 2, 3, each of which are polarized in the plate thickness direction, are opposed to each other. In the piezoelectric members 2, 3 embedded in substrate 1 and a portion of substrate 1 in the back of the piezoelectric members 2, 3, a plurality of grooves 4 are formed in parallel spaced from each other at a prescribed interval by cutting. Piezoelectric members 2, 3 partitioning the respective grooves and substrate 1 constitute "side walls."

An ink supply path 8 from which ink is supplied into the grooves is formed by adhering a top plate frame 5 and top plate lid 7 having ink supply port 6 onto substrate 1. A nozzle plate 11 in which nozzles 10 for ejecting an ink droplet are formed is fixed by gluing to the forefronts where top plate lid 7, top plate frame 5, piezoelectric members 2, 3, and substrate 1 conjoin. An electrode 12 that drives piezoelectric members 2, 3 is formed electrically independently from each other within the interior wall of the groove and extends to an upper surface of substrate 1. The respective electrodes are connected to a drive circuit (later described) that is provided on a circuit board 13.

The piezoelectric member forming the side wall serves as an actuator, which deflects by a voltage applied between two electrodes sandwiching the actuator. A room defined by top plate frame 5 on the front and a portion of the grooves at a length L forms a pressure chamber for ejecting ink.

The grooves are formed at desired dimensions of depth, width, and length by cutting substrate 1 and piezoelectric members 2 and 3 as specified by a disc diamond cutter. The electrodes are formed such that, after the rest of the groove and substrate 1 other than a portion to be plated is masked by a resist beforehand and wholly electroless-plated, the mask is peeled off the groove surface. Alternatively, after forming a film with an electrode material by a spattering or vacuum deposition process on the surface, a desired pattern of electrode can be shaped up by etching.

Figure 2:
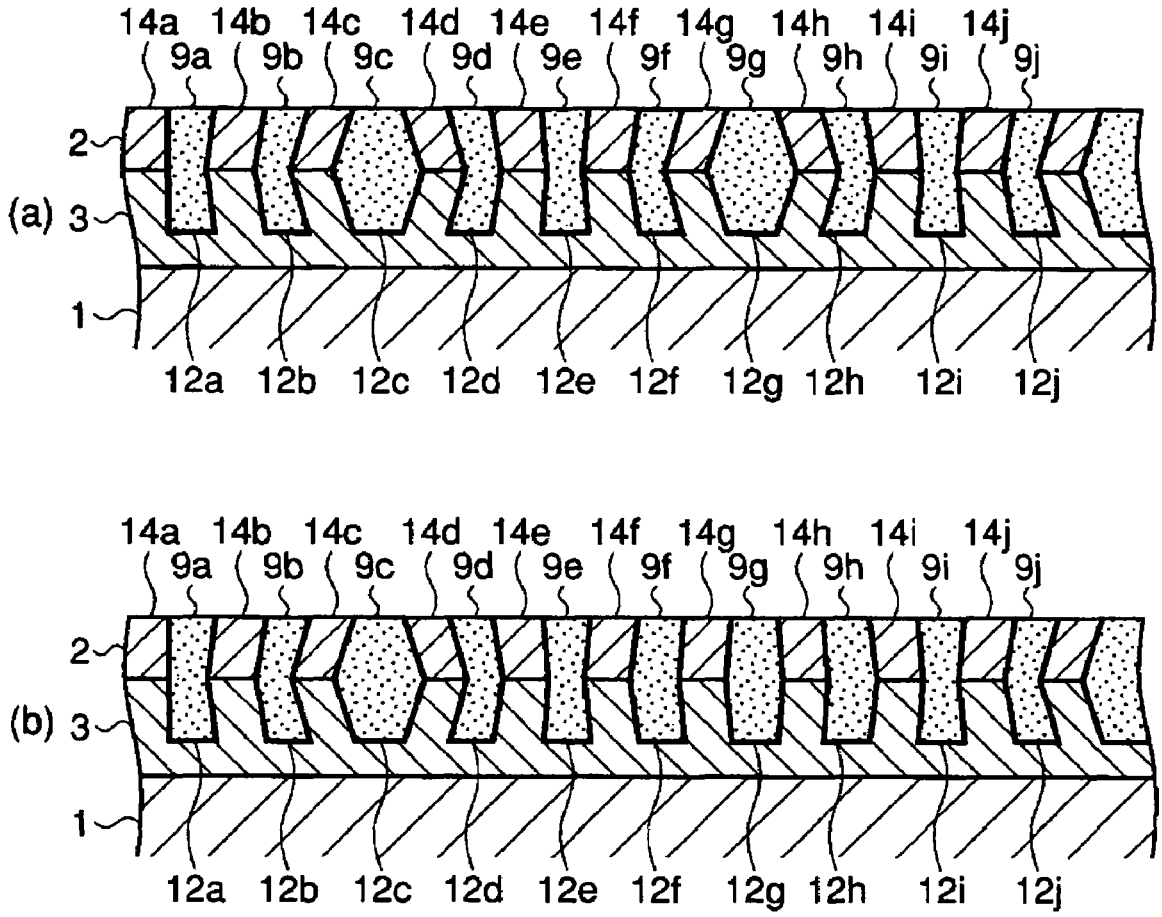
FIG. 2 is a transverse cross sectional view of an apical end of the ink jet recording head according to the same embodiment for describing operation of the head.

FIG. 2 is a transverse sectional view illustrating a structure of the fore end of the ink jet recording head. Operation of the ink jet recording head will now be described in reference to this FIGURE. In the FIGURE, reference numerals 9*a*-9*j* denote pressure chambers; 12*a*-12*j* denote electrodes formed within pressure chambers 9*a*-9*j*; 14*a*-14*j* denote actuators consisting of respective piezoelectric members 2 and 3 that are formed as side walls between the respective pressure chambers.

Now, how an ink droplet is ejected from pressure chambers 9*c* and 9*g* will be described as in the case that the ink jet recording head is operated in the time-division driving method. Description hereafter will be made as nozzles 10*a*-10*j* associating with pressure chambers 9*a*-9*j*, respectively.

Ink supplied into the ink jet recording head from ink supply port 6 is filled in pressure chamber 9 through ink supply path 8. In operating this ink jet recording head in four time-divisional drive method, when a potential difference is presented between the electrodes 12*c* and 12*b*, and concurrently 12*c* and 12*d*, actuators 14*c* and 14*d* are caused to deflect in the shear mode thereby varying a volume of pressure chamber 9*c* so that an ink droplet is ejected from nozzle 10*c*. Similarly, when a potential difference is presented between the electrodes 12*g* and 12*f*, and concurrently 12*g* and 12*h*, actuators 14*g* and 14*f* are caused to deflect in the shear mode thereby varying a volume of pressure chamber 9*g* so that an ink droplet is ejected from nozzle 10*g*.

This ink jet recording head is a so-called shared wall type recoding head, in which one actuator 14 is shared by two pressure chambers 9 that neighbor to it on the both sides. Because one actuator is shared by two pressure chambers, mutually neighboring two pressure chambers 9 cannot be concurrently operated. For this reason, in this recording head the time divisional driving method is employed, in which pressure chambers of every even number of four or more are driven so as to be able to eject inks concurrently while preventing mutually neighboring two pressure chambers from operating at a time. In other words, printing is controlled such that signals that drive every even number N pressure chambers from which inks are made to be ejected at a time are applied to the electrodes provided within the respective pressure chambers, where $N=2M$ ($M \geqq 2$). In this embodiment, operation is described, by way of example, in four time-divisional drive method.

Furthermore, for example, in the case where ink is made to be ejected from pressure chamber 9*c*, voltages are imparted also between electrodes 12*a* and 12*b*, and between 12*d* and 12*e*, whereby actuators 14*b* and 14*e* are driven to deflect so that pressure vibrations of ink produced within pressure chambers 9*b* and 9*d* can be deconcentrated towards pressure chambers 9*a* and 9*e*. Similarly, in the case where ink is made to be ejected from pressure chamber 9*g*, voltages are imparted also between electrodes 12*e* and 12*f*, and between 12*h* and 12*i*, whereby actuators 14*f* and 14*i* are driven to deflect so that pressure vibrations of ink produced within pressure chambers 9*f* and 9*h* can be deconcentrated towards pressure chambers 9*e* and 9*i*.

In this manner, by deconcentrating pressure vibration of ink produced within a pressure chamber that is not intended to cause ink ejection towards others, amplitude of a meniscus vibration at the non-ink-ejecting nozzle can be reduced. As a result, meniscus protruding from a surface of a non-ink-ejecting nozzle caused by the subsequent vibration can be suppressed. This effects reduction in terms of variation of meniscus positions and ejection velocities of ink droplets, thus improving recording quality.

Next, the drive signal generator that generates a signal to drive the ink jet recoding head will be described.

Figure 3:
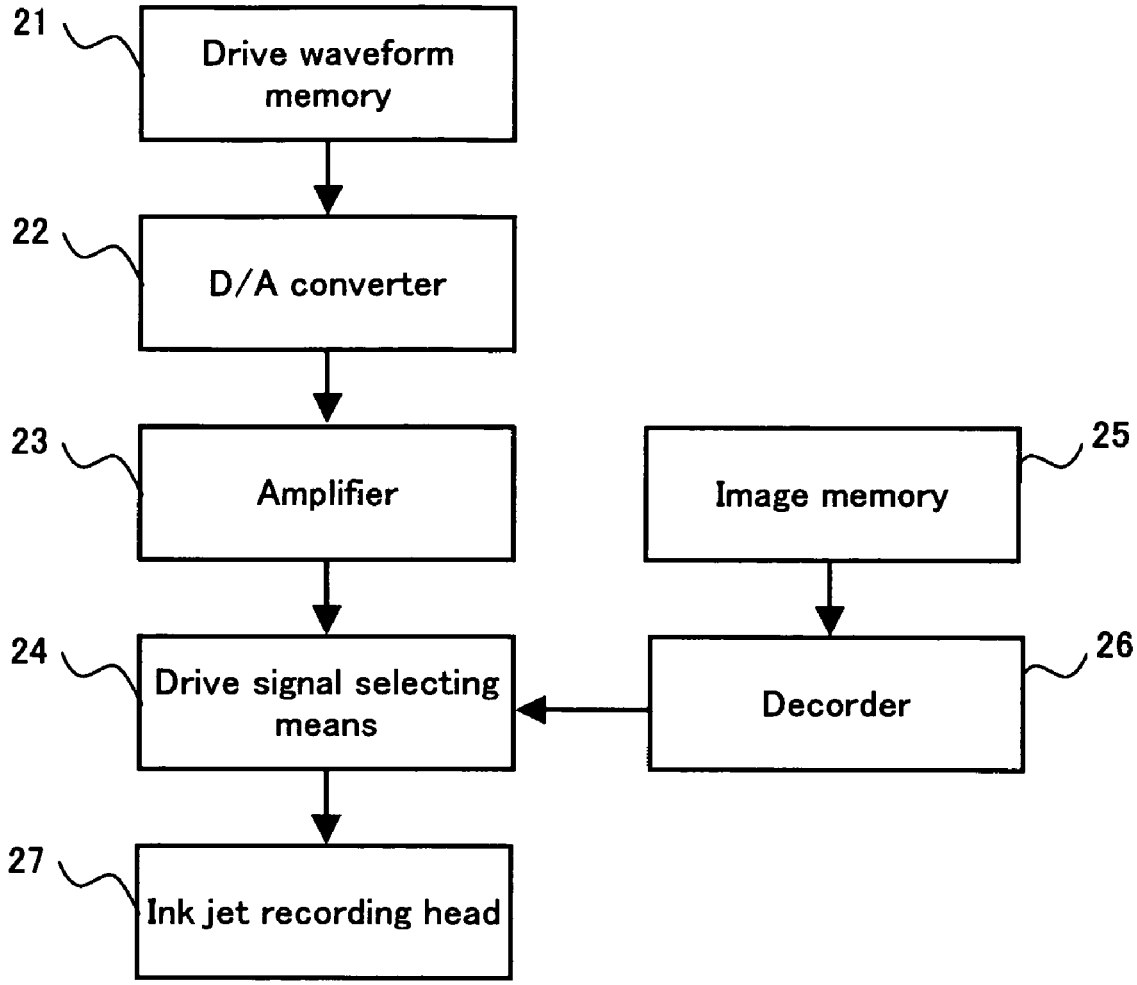
FIG. 3 is a block diagram of a drive circuit in the ink jet recording head according to the same embodiment.

As shown in FIG. 3, the drive signal generator is constituted by a drive waveform memory 21, D/A converter 22, amplifier 23, drive signal selecting means 24, image memory 25, and decoder 26. Drive waveform memory 21 memorizes information on waveforms of drive signals ACT1-ACT 4 that are applied to pressure chambers 9 causing ink to be ejected, and information on waveforms of drive signals INA1-INA4 that are applied to pressure chambers 9 not causing ink to be ejected. D/A converter 22 receives information on waveforms of drive signals ACT1-

ACT 4 and INA1-INA4, and converts the waveform information into analog signals. Amplifier 23 amplifies these drive signals ACT1-ACT 4 and INA1-INA4 now converted into analog signals, and outputs them to drive signal selecting means 24. The drive signals are selected through decoder 26 based on information on gradation of each pixel in an image memorized in image memory 25. Decoder 26 generates ON/OFF signals that determines ejection or non-ejection of an ink droplet according to the gradation information of each pixel in an image memorized in image memory 25, and output the ON/OFF signals to drive signal selecting means 24. Drive signal selecting means 24 selects a drive signal from drive signals ACT1-ACT 4 and INA1-INA4 according to the ON/OFF signals, and applies it to the ink jet recording head.

In this embodiment, recoding is carried out at gradation of eight levels at maximum per a pixel. That is, this eight level gradation recording is carried out by controlling ejection or non-ejection of three types of ink droplets consisting of a first drop of 6 pico-liter in a volume of an ejected ink droplet, second drop of 12 pico-liter of an ejected ink droplet, and third drop of 24 pico-liter of an ejected ink droplet in the manner shown in Table 1.

TABLE 1

| Gradation Level | First droplet (a volome of 6 pico liters) | Second droplet (a volome of 12 pico liters) | Third droplet (a volome of 24 pico liters) | Total volume of accumulated droplets |
|---|---|---|---|---|
| 0 | OFF | OFF | OFF | 0 pl |
| 1 | ON | OFF | OFF | 6 pl |
| 2 | OFF | ON | OFF | 12 pl |
| 3 | ON | ON | OFF | 18 pl |
| 4 | OFF | OFF | ON | 24 pl |
| 5 | ON | OFF | ON | 30 pl |
| 6 | OFF | ON | ON | 36 pl |
| 7 | ON | ON | ON | 42 pl |

Figure 4:
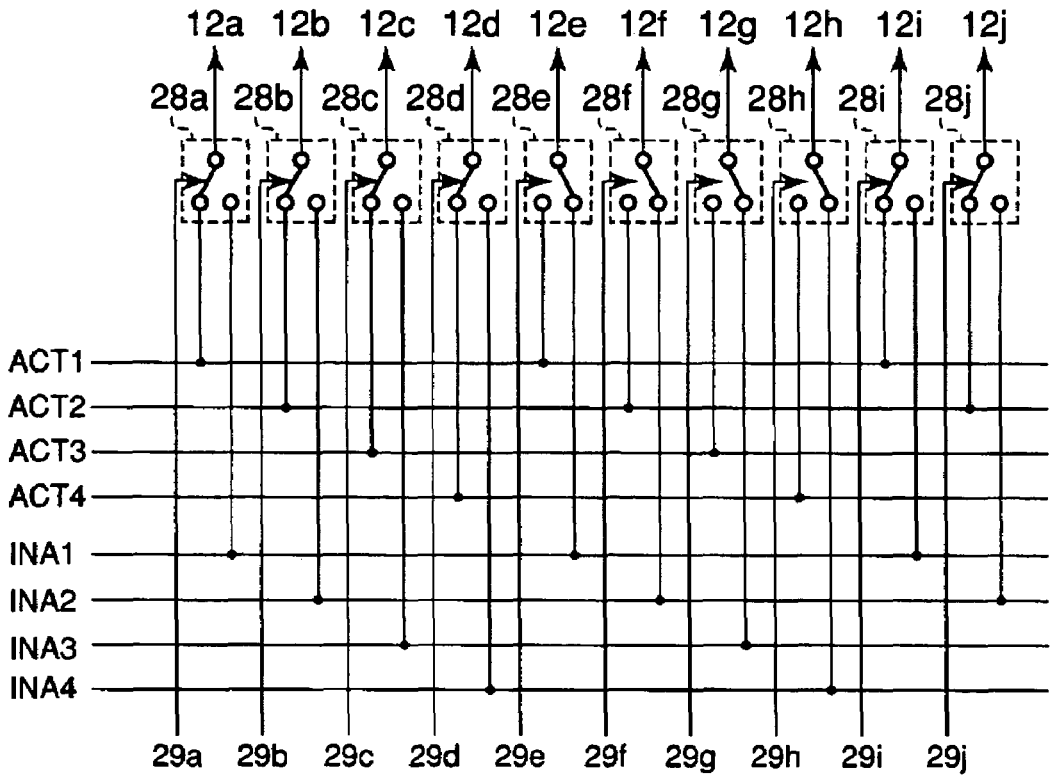
FIG. 4 shows a circuit diagram of the drive signal selecting means indicated in FIG. 3.

Now, drive signal selecting means 24 will be described. As shown in FIG. 4, drive signal selecting means 24 includes analog switches 28*a*-28*j*, which are operated for On/Off switching according to ON/OFF signals 29*a*-29*j* from decoder 26. Although FIG. 4 shows analog switches corresponding to some of electrodes shown in FIG. 2, these switches are actually provided corresponding to electrodes 12 of all the pressure chambers 9 in the recording head.

When ON/OFF signals 29*a*-29*d* are "on," analog switches 28*a*-28*d* select drive signals ACT1-ACT4 that are input from amplifier 23 and lead the signals to electrodes 12*a*-12*d* of ink jet recording head 27, respectively. When ON/OFF signals 29*a*-29*d* are "off," analog switches 28*a*-28*d* select drive signals INA1-INA 4 also input from amplifier 23 and lead the signals to electrodes 12*a*-12*d* of ink jet recording head 27, respectively.

When ON/OFF signals 29*e*-29*h* are "on," analog switches 28*e*-28*h* select drive signals ACT1-ACT4 that are input from amplifier 23 and lead the signals to electrodes 12*e*-12*h* of ink jet recording head 27, respectively. When ON/OFF signals 29*e*-29*h* are "off," analog switches 28*e*-28*h* select drive signals INA1-INA4 also input from amplifier 23 and lead the signals to electrodes 12*e*-12*h* of ink jet recording head 27, respectively. To be more specific, when ON/OFF signals 29*i*, 29*j* are "on," analog switches 28*i*, 28*j* . . . select drive signals ACT1, ACT2 . . . that are input from amplifier 23 and lead the signals to electrodes 12*i*, 12*j* . . . of ink jet recording head 27, respectively; when ON/OFF signals 29*i*, 29*j* . . . are "off," analog switches 28*i*, 28*j* . . . select drive signals INA1, INA2 . . . that are input from amplifier 23 and lead the signals to electrodes 12*i*, 12*j* . . . of ink jet recording head 27, respectively.

Drive signals ACT1-ACT4 correspond to the first through fourth cycle in four time-divisional driving method. For example, at a certain timing if an ink droplet is desired to be ejected from pressure chamber 9*c* but not from pressure chamber 9*g* which is apart from 9*c* by four positions at the same operation timing, ON/OFF signal 29*c* relative to pressure chamber 9*c* and ON/OFF signals 29*a*, 29*b*, and 29*d*, which relate to two respective positions on the both side of pressure chamber 9*c*, are turned on, while ON/OFF signal 29*g* relative to pressure chamber 9*g* and ON/OFF signals 29*e*, 29*f*, and 29*h*, which relate to two positions on the both side of pressure chamber 9*g*, are turned off. According to these ON/OFF signals 29*a*-29*h*, drive signals ACT3, ACT1, ACT2, and ACT4 are given to pressure chamber 9*c* from which ink is made to be ejected, and 9*a*, 9*b*, and 9*d* on the both sides of pressure chamber 9*c*, respectively, while drive signal INA3, INA1, INA2, and INA4 are given to pressure chamber 9*g* from which ink is made not to be ejected, and 9*e*, 9*f*, 9*h* on the both side of pressure chamber 9*g*, respectively.

Drive signals ACT1-ACT4 for ejecting ink and drive signal INA1-INA4 for not ejecting ink supplied to drive signal selecting means 24 are now described.

Figure 5:
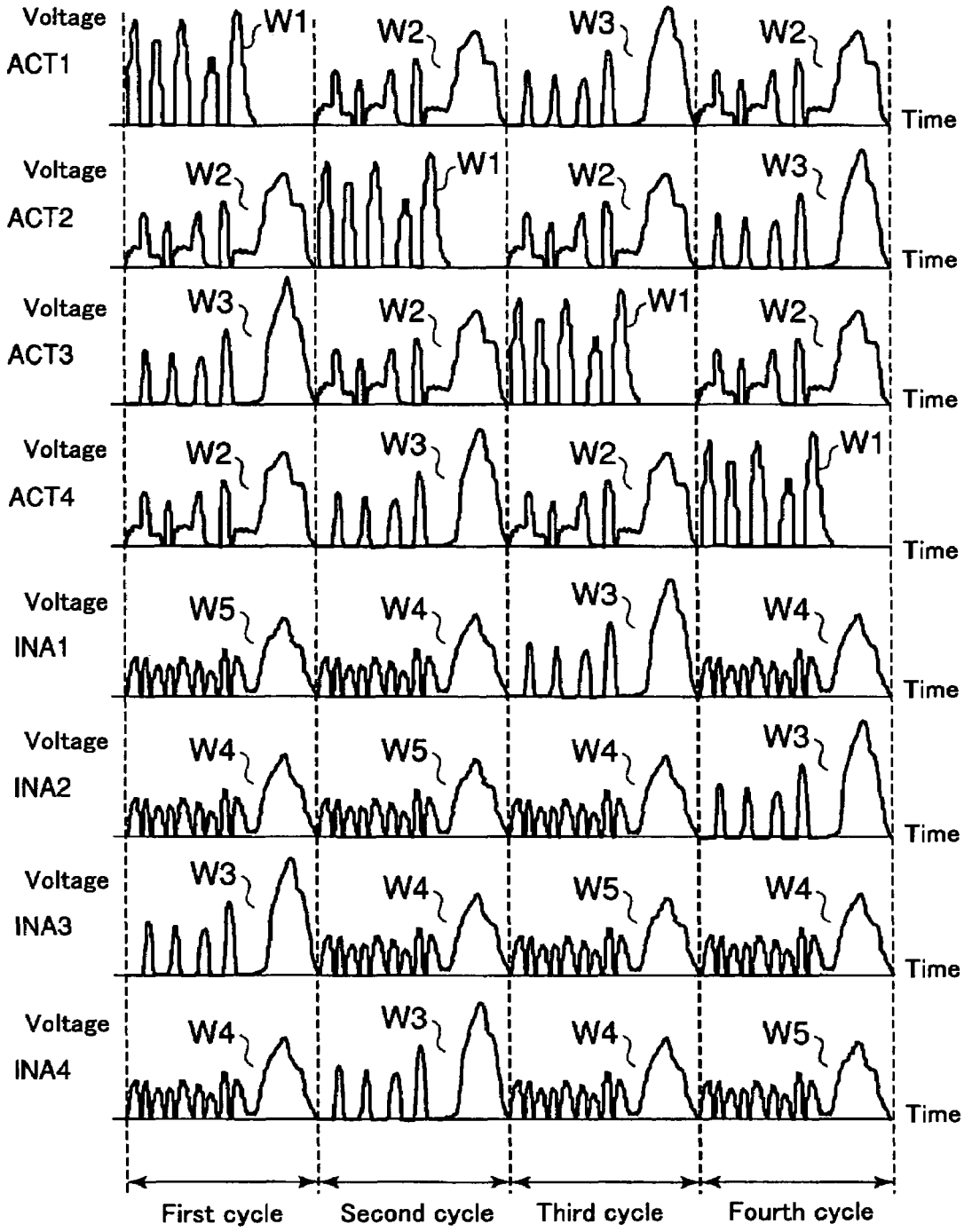
FIG. 5 shows waveforms of drive signals inputted to the drive signal selecting means indicated in FIG. 3.

In FIG. 5, drive signals ACT1-ACT4 and INA1-INA4 in one printing period each consisting of four cycles are displayed. The respective drive signals ACT1-ACT4 include three different types of drive signals W1, W2, and W3, while drive signals INA1-INA4 include three drive signals of W3, W4, and W5. Drive signal W1 is one that is applied to electrode 12 relative to pressure chamber 9 from which an ink droplet is to be ejected.

The respective drive signals ACT1-ACT4 differ in "phase" from one to another by a division cycle. For example, when pressure chamber 9*c* in FIG. 2 is desired to eject an ink droplet, this pressure chamber 9*c* is operated in the third cycle. In this third cycle, first, by activating ON/OFF signals 29*a*-29*d*, drive signal W3 is applied to electrodes 12*a* relative to pressure chambers 9*a*, drive signal W2 is applied to electrodes 12*b* and 12*d* relative to pressure chambers 9*b* and 9*d*, respectively; and drive signal W1 is applied to electrode 12*c* relative to pressure chambers 9*c*.

Figure 6:
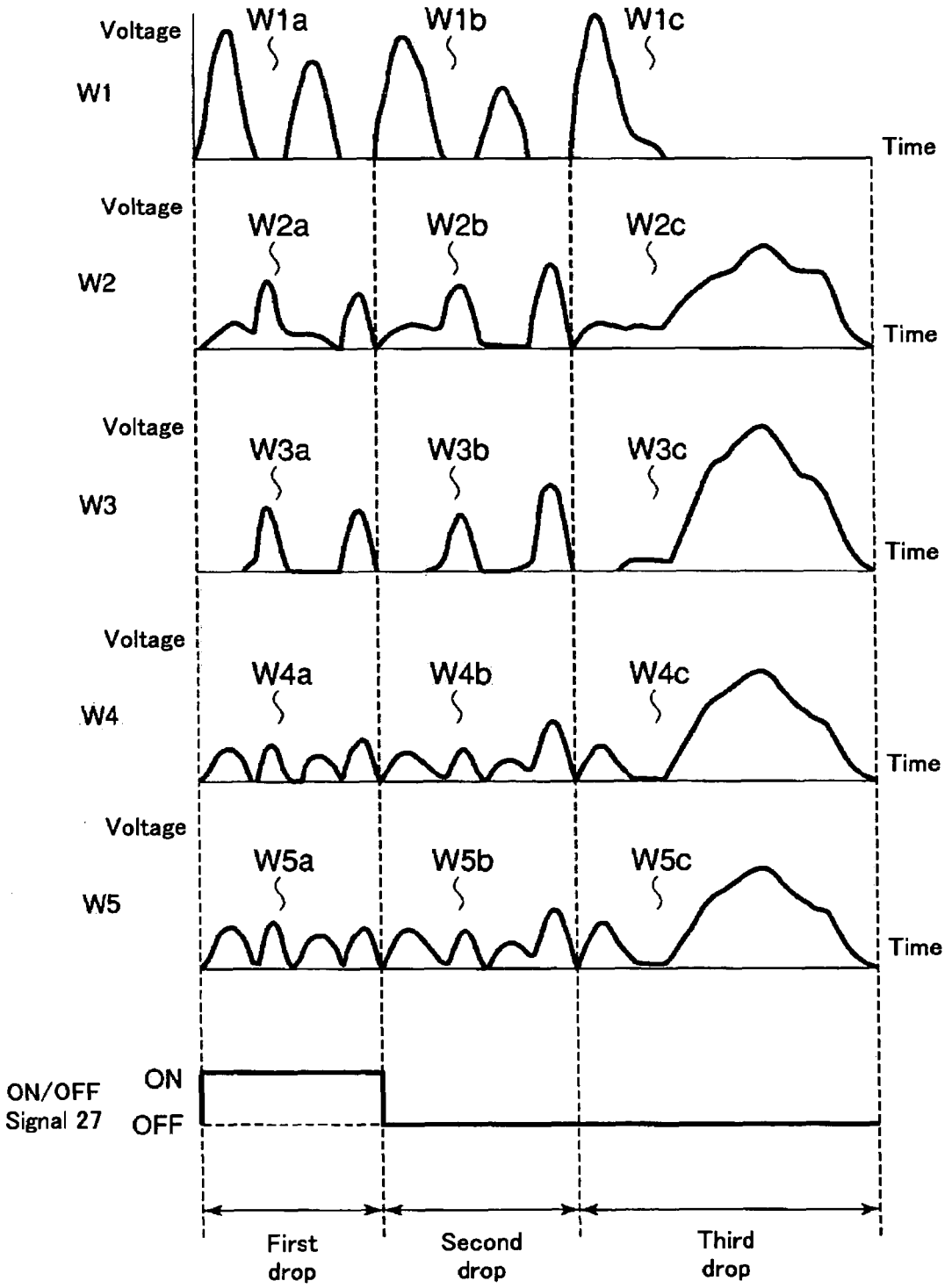
FIG. 6 shows component voltage waveforms constituting the drive signal waveforms depicted in FIG. 5.

Next, drive signals W1 through W5 will be described. As shown in FIG. 6, individual drive signals W1, W2, W3, W4 and W5 are constituted by drive signals W1*a*, W2*a*, W3*a*, W4*a* and W5*a*, all residing at the stage where ejection of the first drop having a volume of 6 pico-litres takes place, W1*b*, W2*b*, W3*b*, W4*b* and W5*b*, all residing at the stage where ejection of the second drop having a volume of 12 pico-litres takes place, and W1*c*, W2*c*, W3*c*, W4*c* and W5*c*, all residing at the stage where ejection of the third drop having a volume of 24 pico-litres takes place, respectively.

For example, in the case that the first drop is to be ejected from both pressure chambers 9*c* and 9*g* as shown in FIG. 2(*a*), ON/OFF signals 29*a*-29*h* are turned on at the first-drop stage within the third cycle. Among drive signals W1*a*, W2*a*, and W3*a*, depicted in FIG. 6, drive signal W1*a* is applied to electrodes 12*c* and 12*g*; drive signal W2*a* to electrodes 12*b*, 12*d*, 12*f*, and 12*h*; and drive signal W3*a* to electrodes 12*a*, 12*e*, and 12*i*. Actuators 14*c*, 14*d*, 14*g*, and 14*h* are largely caused to deflect by virtue of a potential difference between drive signals W1*a* and W2*a* so that ink droplets each having a volume of 6 pico litres are ejected from pressure chambers 9*c* and 9*g*. Other actuators 14*b*, 14*e*, 14*f*, and 14*i* are caused to deflect by virtue of a potential difference between drive signals W2*a* and W3*a* so as to deconcentrate pressure vibrations produced in pressure chambers 9*b*, 9*d*, 9*f*, and 9*h* towards pressure chambers 9*a*, 9*e*, and 9*i*. Thus, variations in velocity and volume of ejected ink droplets caused by meniscus protrusions from nozzle surfaces are sufficiently reduced.

In other case that the first drop is to be ejected from pressure chamber 9*c* but not from pressure chamber 9*g* as shown in FIG. 2(*b*), ON/OFF signals 29*a*-29*d* are turned on at the first-drop stage within the third cycle, and ON/OFF signals 29*e*-29*h* are turned off at the same stage. Thereby, at the same stage of the cycle drive signal W1*a* is applied to electrode 12*c*, drive signal W2*a* to electrodes 12*b* and 12*d*, and drive signal W3*a* to electrodes 12*a* and 12*e*, drive signal W4*a* to electrodes 12*f* and 12*h*, and drive signal W5*a* to electrode 12*g*.

Consequently, actuators 14*c* and 14*d* are largely caused to deflect by virtue of a potential difference between drive signals W1*a* and W2*a* so that an ink droplet having a volume of 6 pico litres is ejected from pressure chambers 9*c*. Actuator 14*f* is caused to deflect by virtue of a potential difference between drive signals W3*a* and W4*a* in the same manner as in the case where the first drop is ejected from pressure chamber 9*g* as described above. Even in the case that ink ejection is not made from pressure chamber 9*g*, pressure vibrations produced in pressure chambers 9*a*-9*e* become the same as in the case that ink ejection is made from pressure chamber 9*g* so that cross-talk between the related pressure chambers can be reduced to a sufficiently negligible level. Thus, variations in velocity and volume of ejected ink droplets caused by the cross-talk can be sufficiently reduced.

Actuators 14*g* and 14*h* are caused to deflect by virtue of a potential difference between drive signals W4*a* and W5*a* so as to disperse a pressure vibration produced in pressure chamber 9*f*. Since, by dispersing this pressure vibration, pressure vibrations produced in pressure chambers 9*f*-9*h* become extremely small, the possibility of accidental ejection of inks from nozzles 10*f*-10*f* is negated.

In the case that the first drop is to be ejected from neither pressure chamber 9*c* nor 9*g*, ON/OFF signals 29*a*-29*h* are turned off at the first-drop stage within the third cycle. At this stage of the cycle, drive signal W3*a* is applied to electrodes 12*a* and 12*e*; drive signal W4*a* to electrodes 12*b*, 12*d*, 12*f*, and 12*h*; and drive signal W5*a* to electrodes 12*c* and 12*g*. Under this combinational application of the drive signals, some electrical fields depending on potential differences between electrodes that sandwich the respective actuators are produced within actuators 14*b*-14*h*, causing slight deflections the actuators. However, magnitudes of the deflections of the actuators are so small that no accidental ink ejection whatsoever can occur.

Now, how to determine drive signals W1 through W4 will be explained.

Hereinafter, term "vibrating flow velocity" is defined as a time-sequential change in flow velocity of ink.

Drive signals W1-W4 can be obtained by inverse operation of drive signals from responsive characteristics of vibrating flow velocity in response to a drive signal in an ink jet recording head and a hypothetical meniscus vibration neglecting pull-back of a meniscus associated with ink ejection.

Hypothetical meniscus vibration is a meniscus vibration that is linear relative to a drive signal. It is a hypothetical vibration that excludes non-linear components relating to meniscus advancing associated with ink ejection from a nozzle, pull-back of a meniscus occurring immediately after an ink droplet has been ejected from a nozzle, and meniscus advancing associated with an ink refill action by surface tension and other factors, from a meniscus vibration actually produced during operation of ink ejection in an ink jet recording head.

Figure 7:
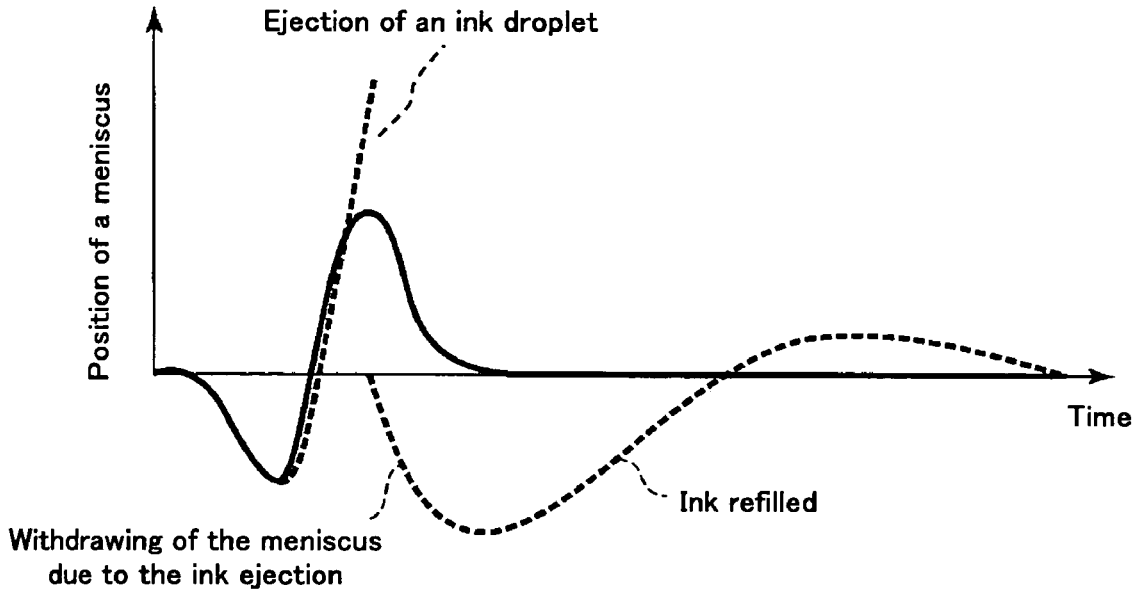
FIG. 7 illustrates a difference between a hypothetical meniscus vibration and an actual meniscus vibration.

The hypothetical meniscus vibration, which is a linear component of a meniscus vibration, can be considered to be an enlarged amplitude of a meniscus vibration produced when a drive signal having an amplitude reduced to a degree insufficient to eject ink is imparted to an ink jet recording head. FIG. 7 illustrates a difference between an actual meniscus vibration and a hypothetical meniscus vibration, wherein a hypothetical meniscus vibration is depicted in a solid line and an actual meniscus vibration in a dashed line.

As shown in FIG. 7, the hypothetical meniscus vibration reflects crucial characteristics relating to behaviors of ink during ink ejection in an ink jet recording head, such as cross talk occurring between the pressure chambers, though it differs from a meniscus vibration produced on actual ink ejection from a nozzle in an ink jet recording head. Meanwhile, since actual meniscus vibration is affected by the aforementioned non-linear component of the vibration, that is, factors irrelevant to the meniscus vibration caused by a drive signal, controlling an actual meniscus vibration by a drive signal is limited. On the contrary, because the hypothetical meniscus vibration is not affected by factors irrelevant to the meniscus vibration derive from a drive signal, it is vary possible to effectively control a meniscus vibration by a drive signal. Thus, by defining a desired hypothetical meniscus vibration and applying a drive signal to actuators so as to cause the vibration, a desirable characteristic in view of cross-talk between pressure chambers and other related phenomenon can be obtained.

Next, the process of carrying inverse calculation for a drive signal from a hypothetical meniscus vibration will be described. First, a response characteristic R of a vibrating flow velocities in response to a drive signal of the ink jet recording head, which is necessitated for the process of inverse calculation for a drive signal from a hypothetical meniscus vibration. Then, a drive signal is calculated from the hypothetical meniscus vibration based on the response characteristic obtained.

Figure 8:
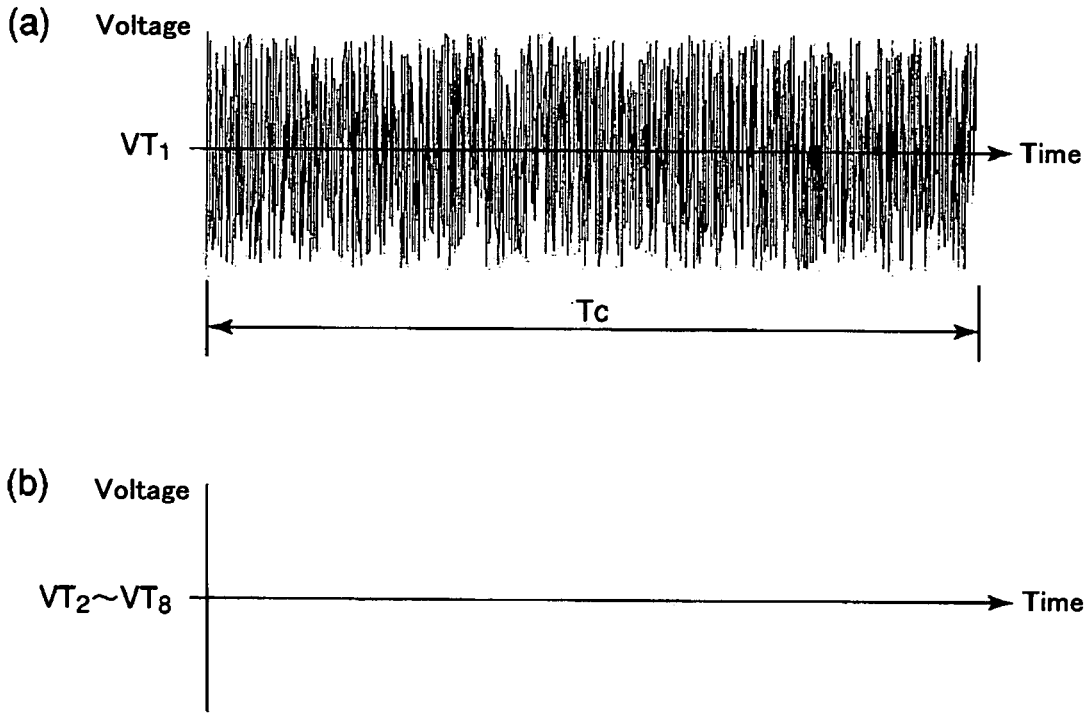
FIG. 8 shows a waveform of a drive signal used for measuring a frequency response characteristic of the recording head according to the same embodiment.
Figure 9:
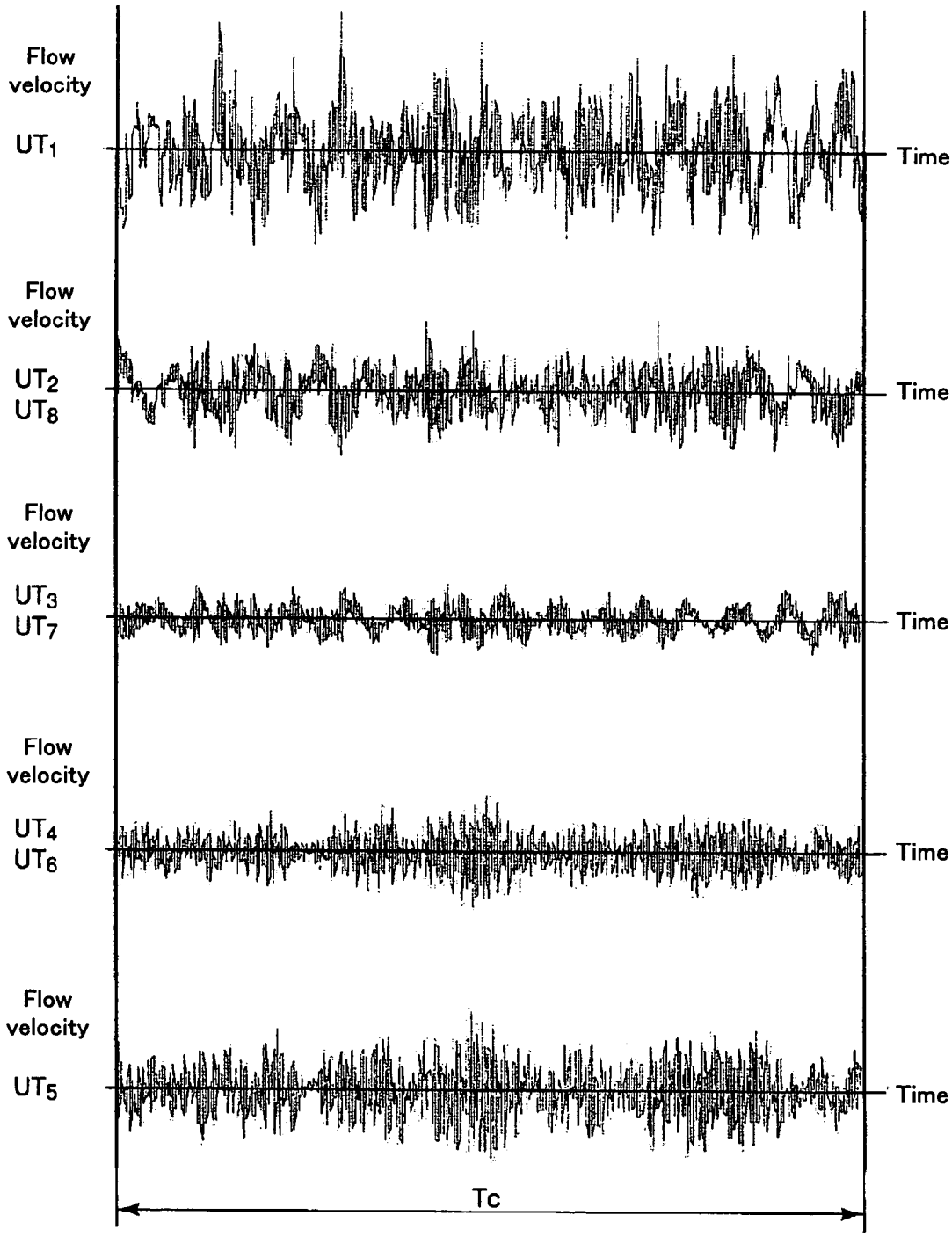
FIG. 9 illustrates vibrating flow velocities of meniscuses responsive to the drive signal for measuring a frequency response characteristic of the recording head in FIG. 8.

The response characteristic R is calculated from a vibrating flow velocity UT within a nozzle responsive to a test drive signal VT. Specifically, test drive signals $VT_1$-$VT_8$ are applied to the respective electrodes 12*a*-12*h*. Drive signal $VT_1$ is a waveform of a noise, as seen in FIG. 8, of a low voltage having a period Tc, and drive signals $VT_2$-$VT_8$ are assumed to be at zero volt. Tc is preferably to be set sufficiently longer than an operation time of an ink ejection process. Furthermore, a drive pattern of every 8 channels is applied among a number of pressure chambers by applying to electrode 12*i* the same drive signal $VT_1$ as one to electrode 12*a*. Letting flow velocities of the respective meniscuses produced in nozzles 10*a*-10*h* when the recording head is driven using the above-mentioned drive pattern be $UT_1$-$UT_8$, vibrating flow velocities having a period of Tc, as shown in FIG. 9, are produced. The term a "channel" used herein indicates a chamber forming an electrode that communicates with one nozzle. It is used to describe a calculation of the hypothetical meniscus vibration. This vibrating flow velocity can be observed by irradiating a meniscus within a nozzle of the ink jet recording head with a laser beam for measuring, using a laser Doppler vibrometer available in the market, for example, Model LV-1710 of Ono Sokki Co., Ltd.

Subsequently, a voltage spectrum FVT and flow velocity spectrum FUT are transformed by operating Fourier-transformation of the test drive signal VT and vibrating flow velocity UT using the following formulas (1) and (2).

$$FVT_{i,k} = \frac{1}{\sqrt{m}} \cdot \sum_{j=1}^{m} VT_{i,j} \cdot e^{2\pi I(j-1)(k-1)/m} \tag{1}$$

$$FUT_{i,k} = \frac{1}{\sqrt{m}} \cdot \sum_{j=1}^{m} UT_{i,j} \cdot e^{2\pi I(j-1)(k-1)/m} \tag{2}$$

In the above formulas, "m" denotes the number of time-series flow velocity data observed by the laser Doppler vibrometer. Letting a sampling time for flow velocity data observed by a laser Doppler vibrometer be "dt," "m" is given as a value of Tc/dt. Subscript "i" is an integer denoting a channel number from 1 to 8 and corresponds to the respective electrode of 12*a*-12*h* or nozzle of 10*a*-10*h*. Subscript "j" is an integer from 1 to m denoting "j"th data from the leading in the time-series data array. "j"th data indicates data of "time j×dt." Subscript "k" is an integer from 1 to k denoting "k"th data from the leading in a sequential frequency data array, and "k"th data indicates data of a frequency "(k−1)/Tc." "I" is presented in imaginary unit. Manner of usage of the above subscripts will be applied in subsequent descriptions. $VT_1$, $UT_1$ are time-series data at a time interval of dt having a length of m, and $FVT_1$, $FUT_1$ are sequential frequency data at a frequency interval of 1/(m dt). Voltage spectrum $FVT_{i,k}$ represents a voltage amplitude and a phase of drive signal $VT_i$ at a frequency of (k−1)/Tc in form of a complex number. Also, flow velocity spectrum $FUT_{i,k}$ represents a flow velosity amplitude and a phase of vibrating flow velocity $UT_i$ at a frequency of (k−1)/Tc in form of a complex number.

Response characteristic R can be obtained from voltage spectrum FVT and flow velocity spectrum FUT in the following formula (3):

$$R_{i,k}=FUT_{i,k}/FVT_{1,k} \tag{3}$$

Figure 10:
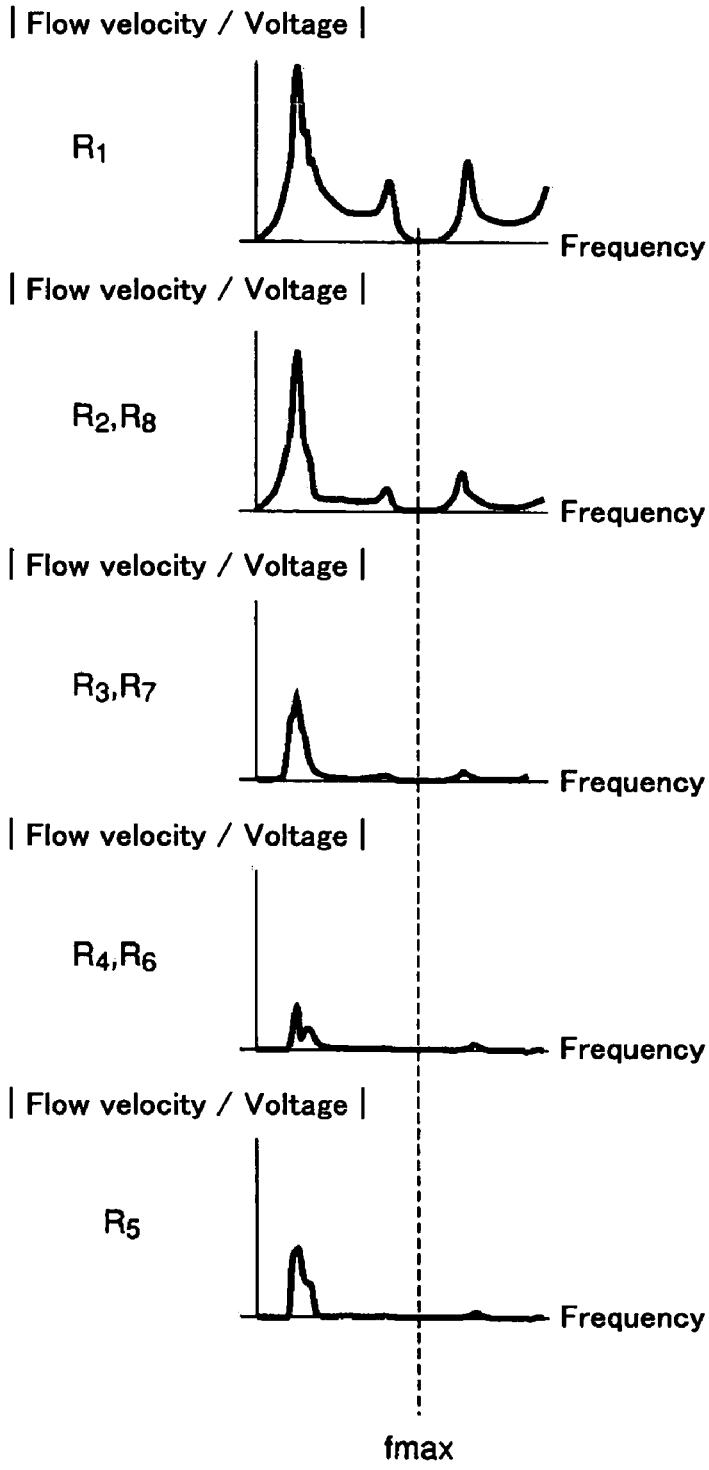
FIG. 10 illustrates response characteristics represented in an absolute value of the recording head according to the embodiment.
Figure 11:
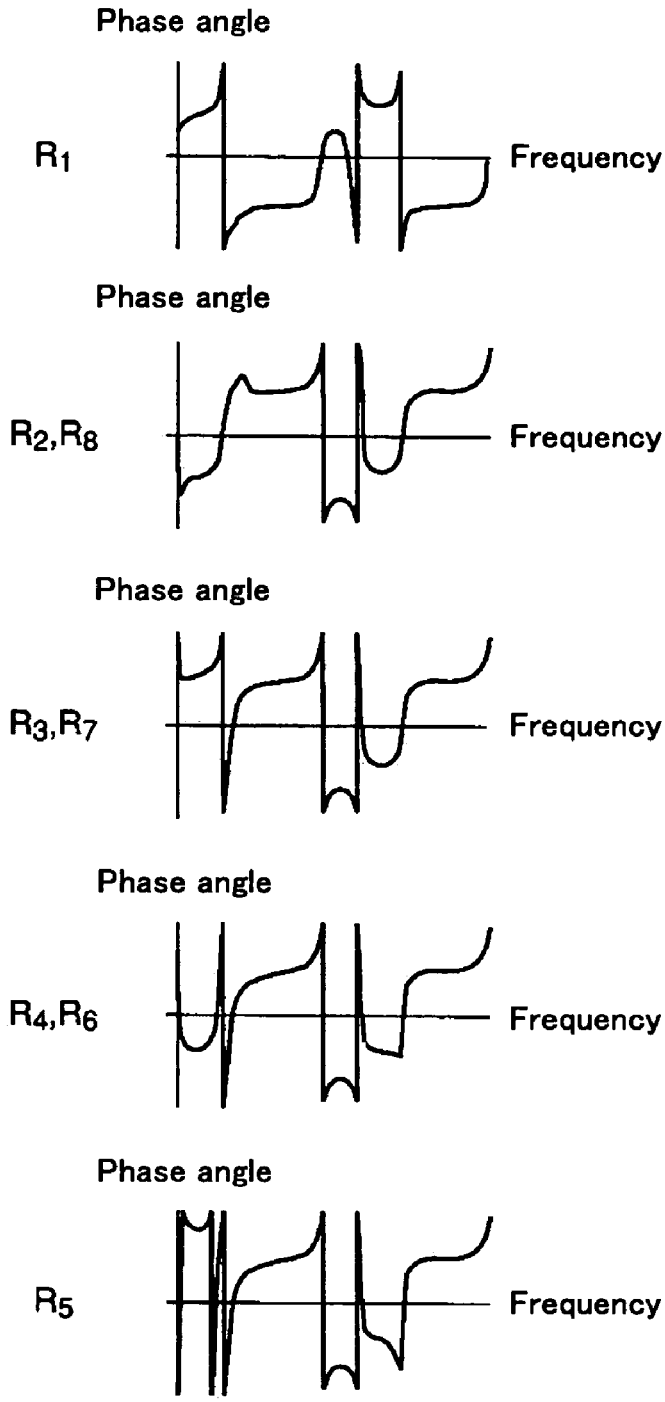
FIG. 11 illustrates response characteristics represented in a phase angle of the recording head according to the embodiment.

$R_{i,k}$ in form of a complex number a variation of amplitude and phase of flow velocity $U_i$ of a meniscus within a nozzle at frequency (k−1)/Tc in responsive to drive signal $VT_1$. If response characteristic of each channel is represented by Ri, absolute values and phase angles in $R_1$-$R_8$ are shown in FIGS. 10 and 11, respectively. "f max" in FIG. 10 indicates an upper limit frequency in the frequency domain where a meniscus in nozzle 10 are responsive to the drive signal continuously from a low frequency part.

The above description has been made for the case where the test drive signal VT used a noise waveform. However, response characteristic R can also be obtained by using sine waves or cosine waves at variable frequencies as the test drive signal and measuring amplitude and phase in vibrating flow velocity of a meniscus in each frequency.

Next, a process of determining the drive signal from a hypothetical meniscus vibration using the response characteristic R obtained in the above will be described.

Figure 12:
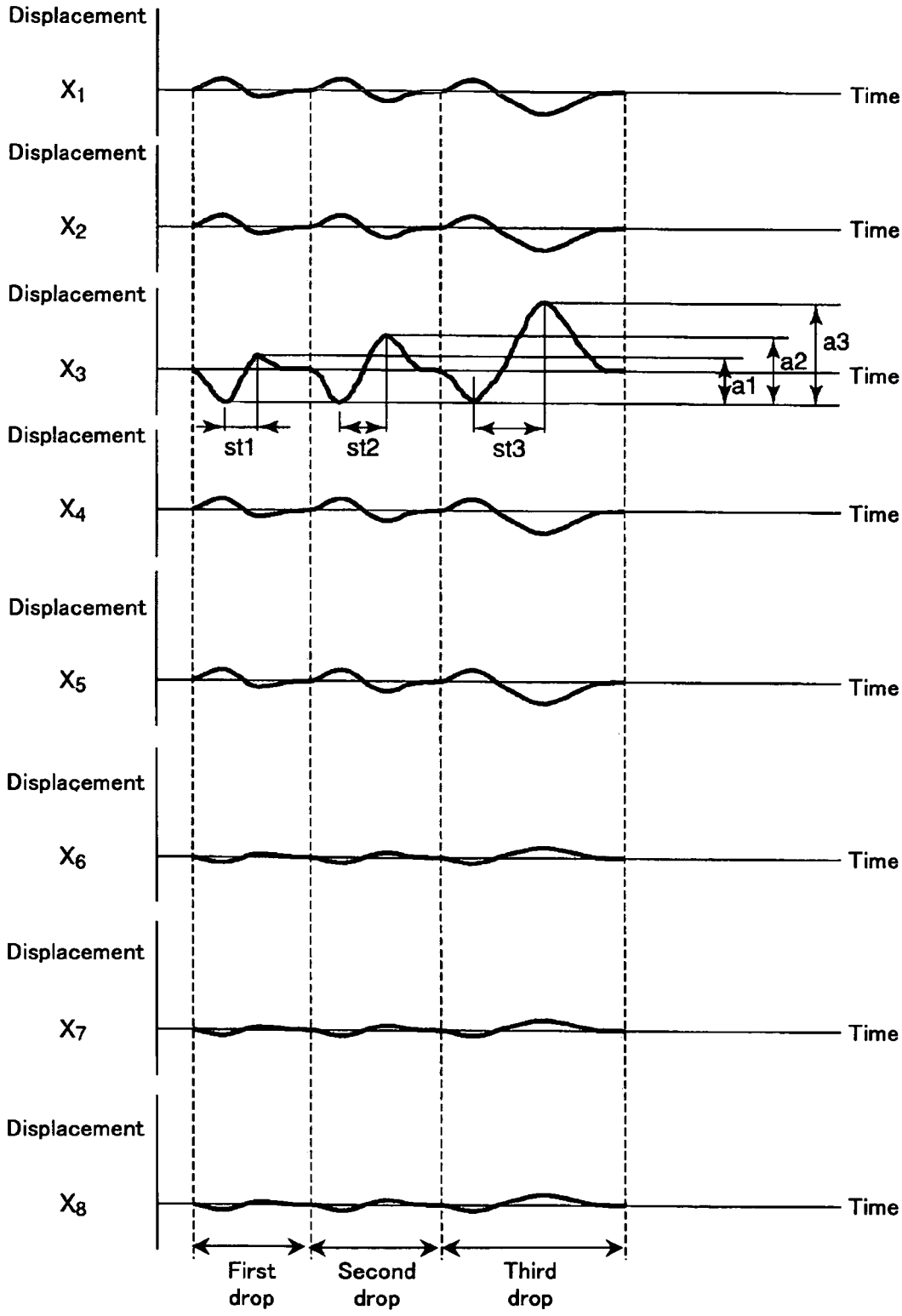
FIG. 12 illustrates an example of a hypothetical meniscus displacement in the embodiment.

FIG. 12 illustrates a displacement X of hypothetical meniscus vibration. For example, in the case that the first through third drops are ejected from pressure chamber 9*c* but none of ink from pressure chamber 9*g*, displacements of hypothetical meniscus vibrations in nozzles 10*a*-10*h* are to be $X_1$-$X_8$, respectively, as shown. A peak value in the positive domain in each of the hypothetical meniscus displacements in the respective pressure chambers corresponds to a volume of an ink droplet ejected.

Now, a hypothetical meniscus flow velocity U relative to a hypothetical meniscus displacement X will be obtained, using formula (4) shown below. For convenience of calculation using formula (4) below, it is assumed that the end point of hypothetical meniscus in terms of displacement X is continuous to the start point, differential values from the starting point to the end are continuous, and the end point and the end in the result of the differential calculation are continuous as well.

$$U_i=d/dt\cdot X_i \tag{4}$$

Figure 13:
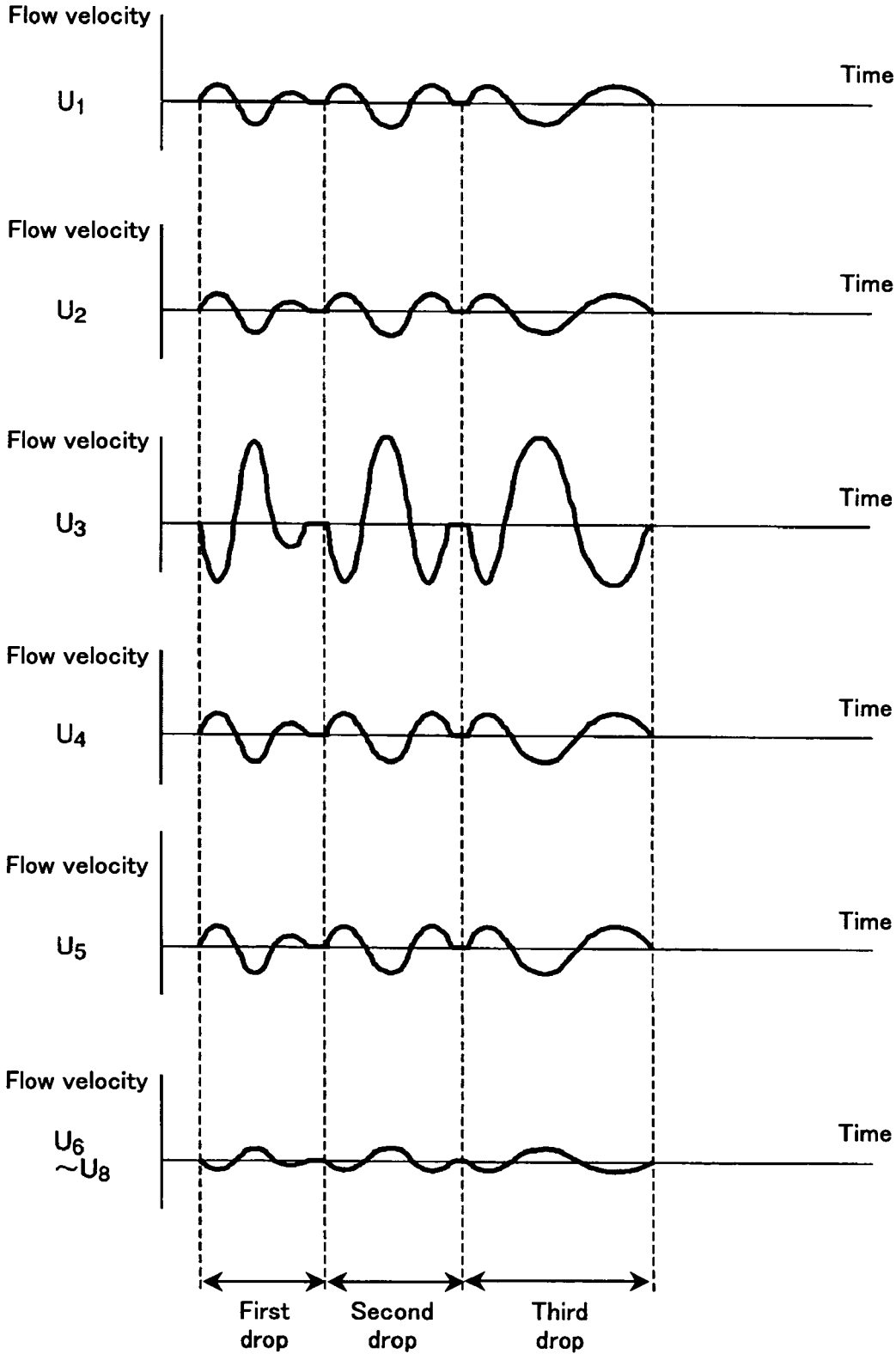
FIG. 13 illustrates flow velocities of a hypothetical meniscus in the embodiment.

FIG. 13 depicts hypothetical meniscus flow velocities $U_1$-$U_8$ obtained using the above formula (4). The hypothetical meniscus flow velocity is a time-series data substantially continuous from the starting point to the end, and the starting point and end point are substantially continuous as well. The hypothetical meniscus flow velocity may be defined at the beginning instead of calculating the value from a hypothetical meniscus displacement.

Next, flow velocity spectrum FU of hypothetical meniscus flow velocity U will be obtained by computing the Fourier transform of hypothetical meniscus flow velocity U using formula (5) shown below.

$$FU_{i,k} = \frac{1}{\sqrt{m}} \cdot \sum_{j=1}^{m} U_{i,j} \cdot e^{2\pi I(j-1)(k-1)/m} \tag{5}$$

Figure 14:
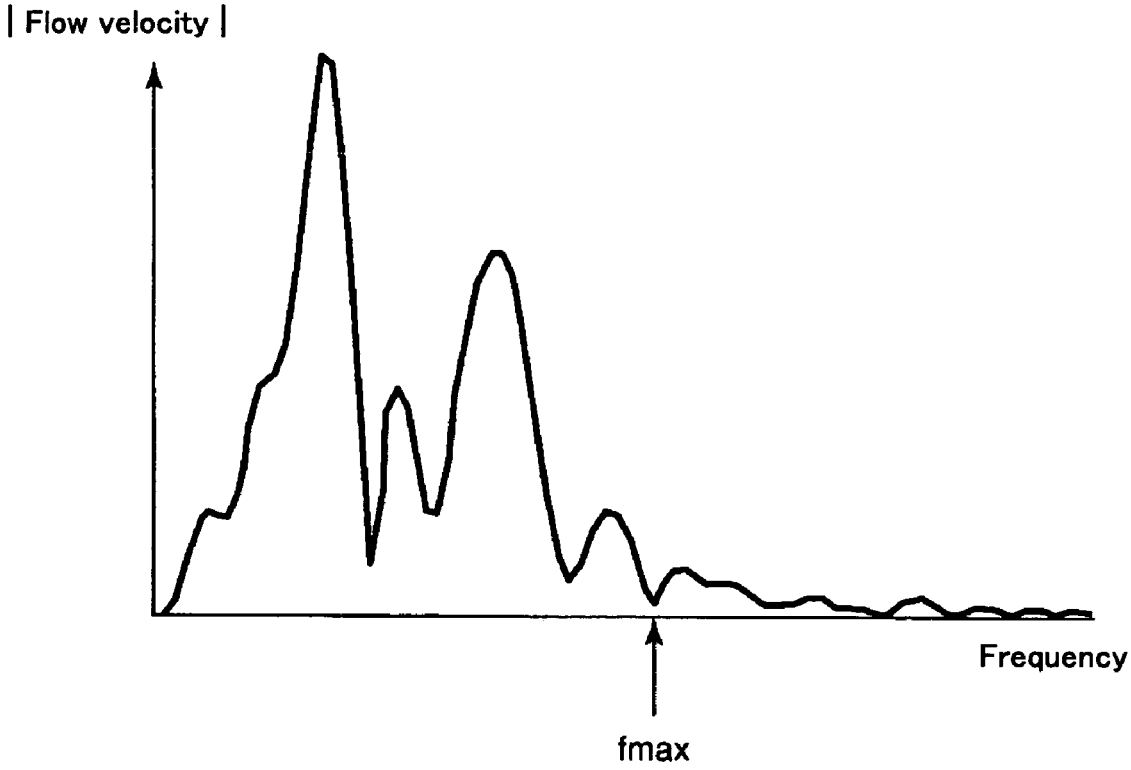
FIG. 14 illustrates a frequency response characteristic of a hypothetical meniscus in the embodiment.

In the above formula, $U_i$ represents time-series data at time interval dt and length m, and $U_{i,j}$ represents ith data from the head data of $U_i$. Flow velocity spectrum $FU_{i,k}$ represents amplitude and phase of the flow velocity in the hypothetical meniscus flow velocity $U_i$ at a frequency (k−1)/Tc in form of a complex number. FIG. 14 depicts $FU_3$ in an absolute value in flow velocity spectrum FU values thus obtained. It is preferable that most part of the frequency component in flow velocity spectrum FU is contained in a range lower than a frequency f max abovementioned as shown in FIG. 14.

Next, voltage spectrum FVA of the drive signal will be obtained from response characteristic R of the ink jet recording head and flow velocity spectrum FU of the hypothetical meniscus vibration. If response characteristic matrix [R] is given by formula (6) shown below, voltage vector $\{FVA\}_k$ is given by formula (7) below, and flow velocity vector $VA_k$ is given by formula (8) below, a voltage vector $FVA_k$ at a frequency (k−1)/Tc can be obtained formula (9) shown below.

$$[R]_k = \begin{bmatrix} R_{1,k} & R_{8,k} & \cdots & & R_2 \\ R_{2,k} & R_{1,k} & & & R_{3,k} \\ \vdots & R_{2,k} & \ddots & & \vdots \\ \vdots & \vdots & & & R_{8,k} \\ R_{8,k} & R_{7,k} & \cdots & R_{2,k} & R_{1,k} \end{bmatrix} \tag{6}$$

$$\{FVA\}_k = \begin{bmatrix} FVA_{1,k} \\ FVA_{2,k} \\ \vdots \\ FVA_{8,k} \end{bmatrix} \tag{7}$$

-continued $$\{FU\}_k = \begin{bmatrix} FU_{1,k} \\ FU_{2,k} \\ \vdots \\ FU_{8,k} \end{bmatrix} \quad (8)$$

$$\{FVA\}_k = [R]_k^{-1} \cdot \{FUA\}_k \quad (9)$$

Voltage spectrum $FVA_{i,k}$ obtained in formulas (7) and (9) represents in form of a complex number a voltage amplitude and phase of drive signal $VA_i$ at a frequency (k−1)/Tc that produces hypothetical meniscus flow velocity $U_i$. The element in row "a" at column "b" of $[R]_k$ obtained in formula (6) represents a variation of amplitude and phase of vibrating flow velocity of a meniscus, in form of a complex number, within a nozzle provided in "a"th channel relating to a voltage vibration in "b"th channel at a frequency (k−1)/Tc. $[R]_k^{-1}$ is an inverse matrix of $[R]_k$. Computation of the inverse matrix can be performed by using mathematical formula analysis software tool "MATHMATICA" provided by WOLFRAM RESEARCH Ltd.

Next, drive signal VA will be calculated. Drive signal VA can be obtained by computing the Fourier inverse transform of voltage spectrum FVA in the following formula (10).

$$VA_{i,j} = \mathrm{Re}\left[\frac{2}{\sqrt{m}} \cdot \sum_{k=1}^{m'} FVA_{i,k} \cdot e^{-2\pi I(k-1)(j-1)/m}\right] \quad (10)$$

Herein, Re[Z] is a function for obtaining a portion of a real number "a" in a complex number z=a+bI. $VA_{i,j}$ represents a voltage of drive signal VA at time j×dt in "i"th channel that produces hypothetical meniscus flow velocity U.

Drive signal $VA_i$ is applied to the recording head as shown in FIG. 1. That is, drive signals $VA_1$-$VA_8$ are applied to electrodes 12*a*-12*h*, respectively, so that hypothetical meniscus displacements $X_1$-$X_8$ are made to occur on meniscuses in nozzles 10*a*-10*h*.

m' is a largest integer in a value given by m'≦f max·Tc. By thus setting the upper limit frequency of the inverse Fourier transform to f max, the upper limit value in the frequency component of drive signal VA is now determined to be "f max."

Figure 15:
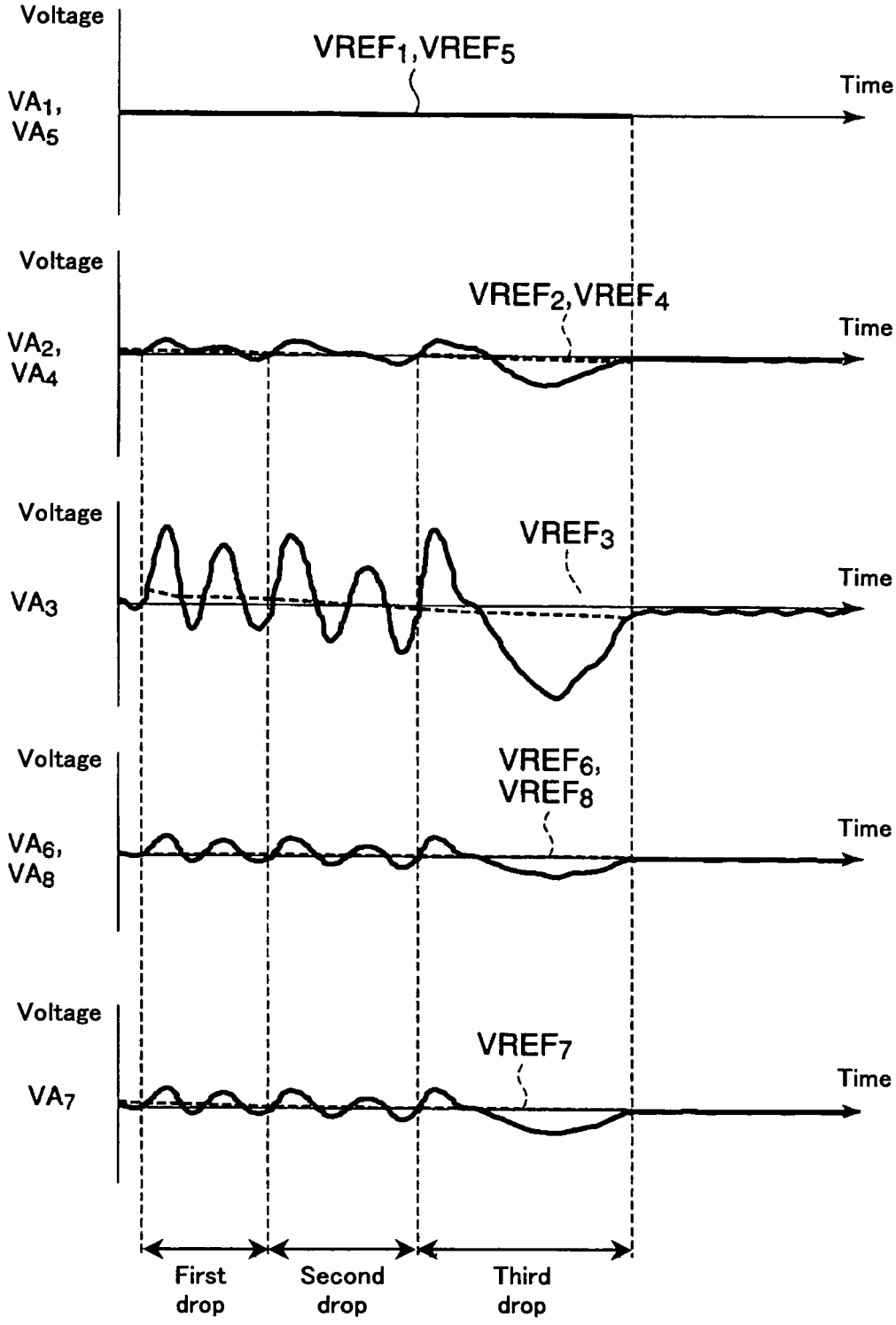
FIG. 15 illustrates waveforms of drive signals each obtained by computation using a flow velocity of a hypothetical meniscus and response characteristic of the recording head according to the embodiment.

When a waveform of the drive signal is calculated back from a hypothetical meniscus vibration using the Fourier transform, a divergence of the calculation result can be prevented by limiting the frequency range in the calculation to between zero and f max, which is the range of a frequency response of the ink jet recording head. To reproduce a hypothetical meniscus vibration at a sufficient accuracy from the drive signal having the waveform obtained by this calculation, it is desirable that "f max" cover the most part of the frequency component in flow velocity spectrum FU. "f max" varies depending on dimensions of the ink jet recording head, such as length L of the pressure chamber. Accordingly, it is desirable that dimensions of the ink jet recording head be adjusted so that "f max" contains the most of the frequency component in flow velocity spectrum FU. FIG. 15 displays drive signal VA ($VA_1$-$VA_8$) obtained in the manner as described above.

Figure 16:
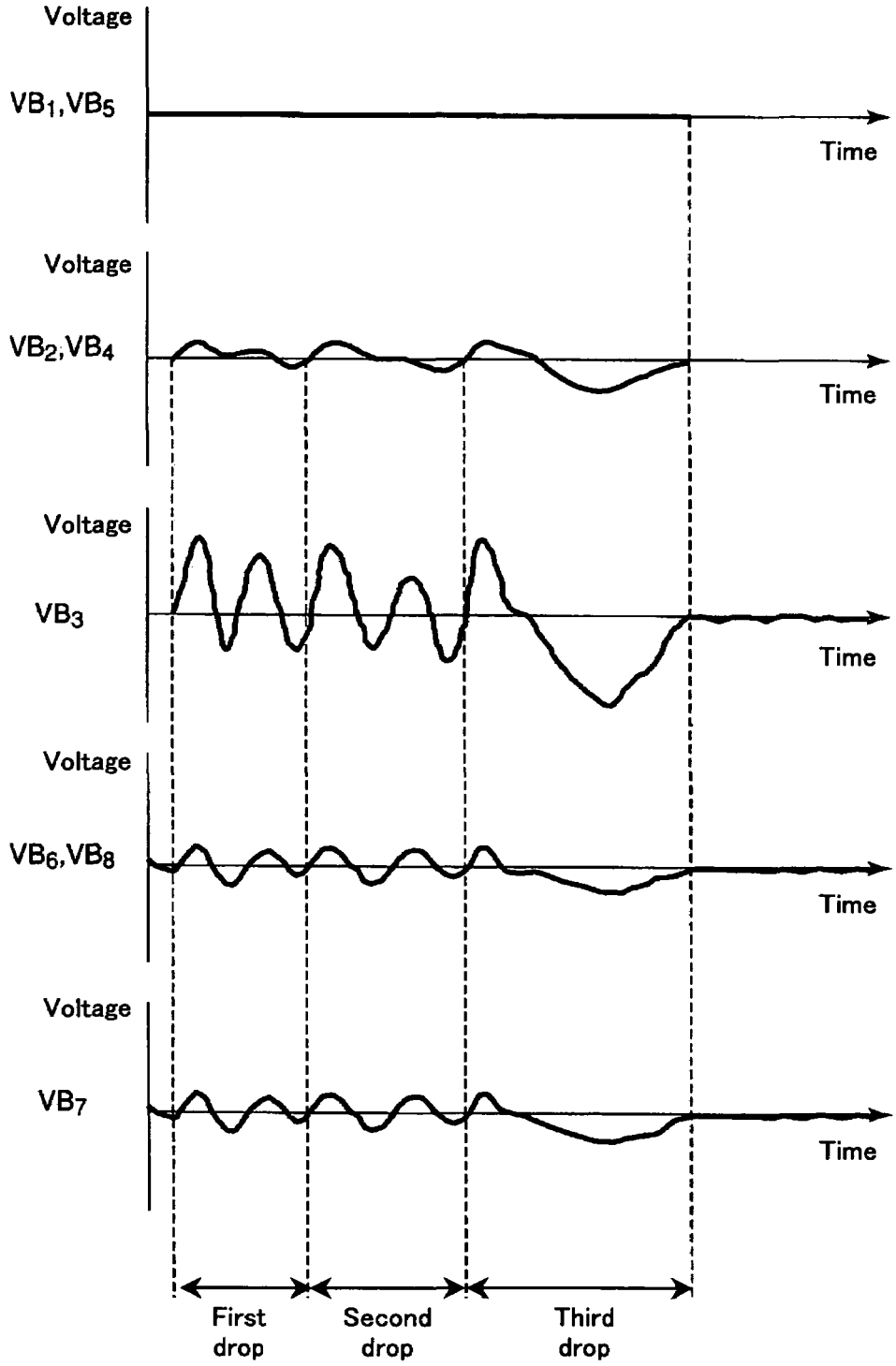
FIG. 16 illustrates drive signal waveforms compensated from the drive signal waveforms shown in FIG. 15.

The drive signal VA thus obtained can be used, as is, as a drive signal in the ink jet recording head. Instead of using drive signal VA, as is, however, drive signal VB ($VB_1$-$VB_8$) shown in FIG. 16 may be produced by calculating a difference between the drive signal VA and reference voltage VREF ($VREF_1$-$VREF_8$) depicted in a dotted line in FIG. 15 so that the time period of the drive signal from the first-droplet to the third droplet can be reduced. Thus, the drive period of the ink jet recording head can be reduced and thereby the printing speed can be improved.

Figure 17:
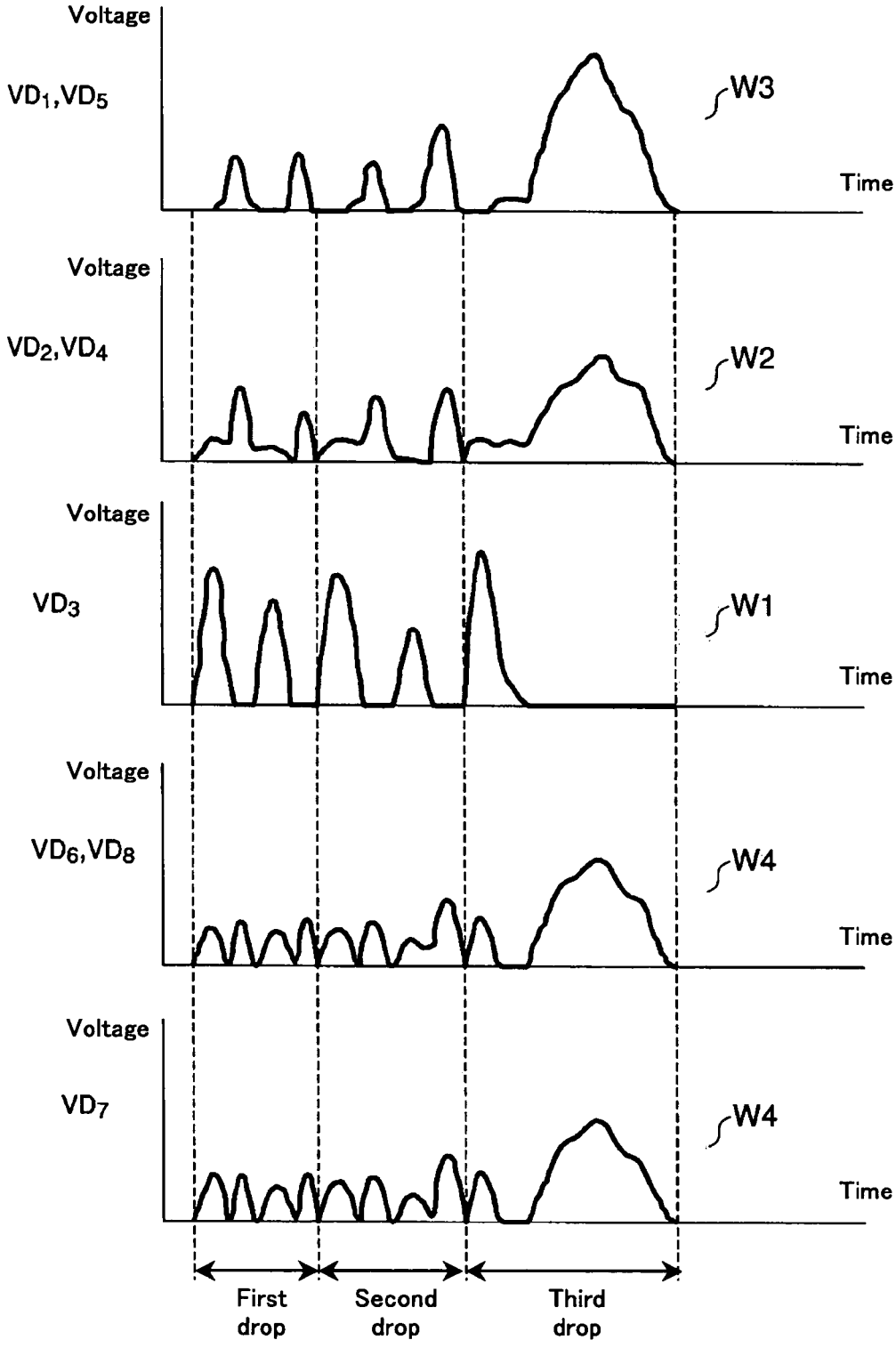
FIG. 17 illustrates drive signal waveforms modified from the drive signal waveforms shown in FIG. 16.

Drive signal VB thus obtained can be used also as is, as drive signal in the ink jet recording head. However, the voltage amplitude can be reduced by using drive signal VD calculated by the following formula (11). This reduction of the voltage amplitude of the drive signal can reduce the cost of a drive circuit of the recording head and hence an inexpensive ink jet recording apparatus can be provided. FIG. 17 displays drive signals $VD_1$-$VD_8$.

$$VD_{i,j} = Vb_{i,j} - \mathrm{MIN}[VB_{1,j}, VB_{2,j}, \ldots VB_{8,j}] \quad (11)$$

Herein, MIN [$VB_{1,j}$, $VB_{2,j}$, . . . $VB_{8,j}$] is a function representing a minimum value in values within the bracket. Drive signal $VD_3$ obtained in this calculation becomes drive signal W1, drive signal $VD_2$ or $VD_4$ becomes drive signal W2, drive signal $VD_1$ or $VD_5$ becomes drive signal W3, drive signal $VD_6$ or $VD_8$ becomes drive signal W4, and drive signal $VD_7$ becomes drive signal W5.

The above method of producing drive signals can be applied to actual production of an ink jet recording apparatus by following the procedure described below. First, a response characteristic R responsive to a drive signal of the ink jet recording head that is manufactured is to be measured, using a test drive signal such as a noise waveform or sine wave. Then, a waveform of drive signal is produced by computing formulas (4) through (10) based on the response characteristic and a predefined hypothetical meniscus vibration. Further, if needed, the waveforms of the drive signal are modified using formula (11) or others. At last, the waveforms thus obtained are stored in drive waveform memory 21 of the ink jet recording apparatus.

Figure 18:
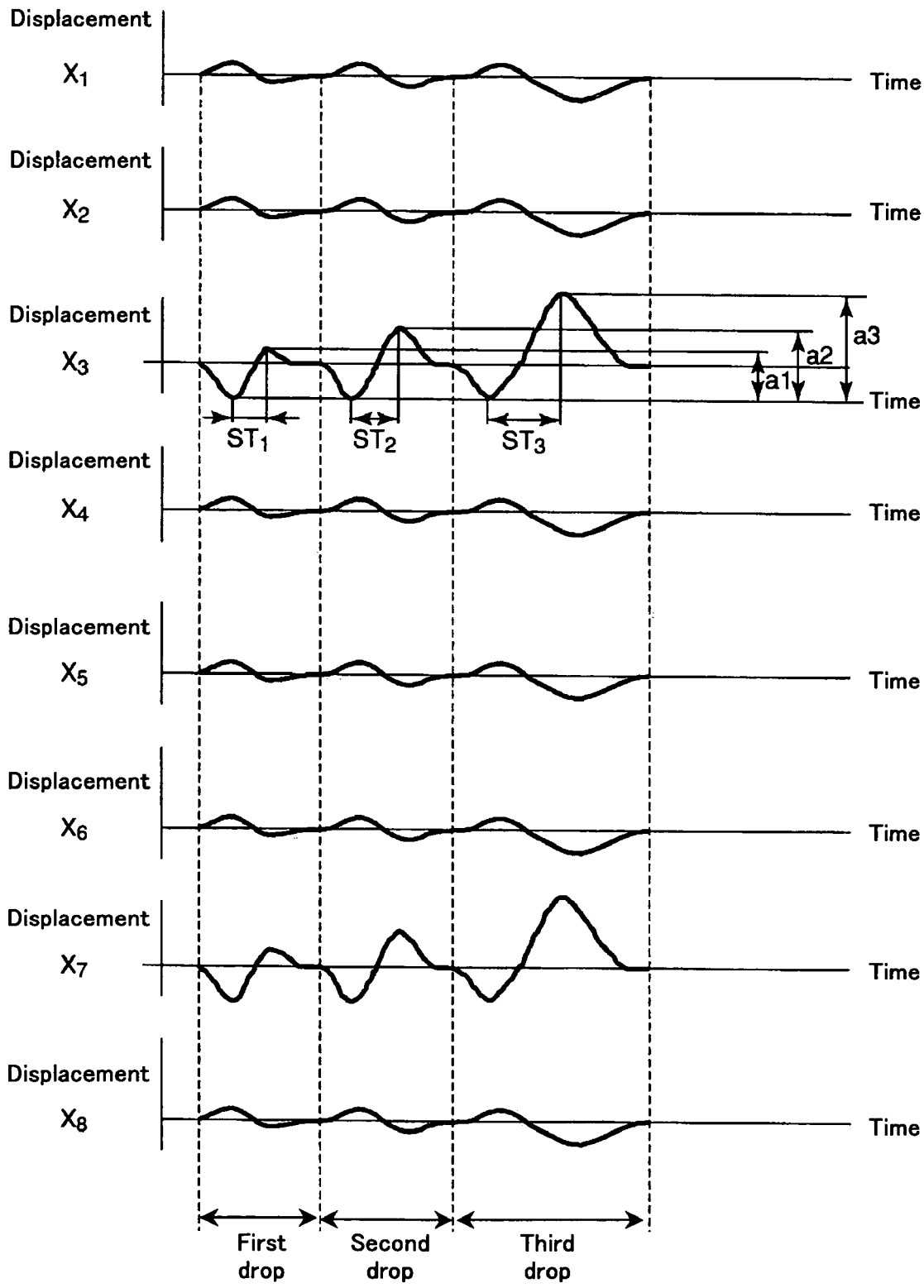
FIG. 18 illustrates a hypothetical meniscus displacement represented in the embodiment.

The hypothetical meniscus vibration will be further described in detail. Displacements $X_1$-$X_8$ shown in FIG. 12 represent displacements of the hypothetical meniscus vibrations within the respective nozzles 10*a*-10*h* wherein the first drop through the third drop are ejected from pressure chamber 9*c* but none is ejected from pressure chamber 9*g*. $U_1$-$U_8$ in FIG. 18 represent displacements of hypothetical meniscus vibrations in the respective nozzles 10*a*-10*h* when the first through third drops are ejected from both of pressure chamber 9*c* and 9*g*.

This embodiment illustrates by examples displacement $X_3$ of the hypothetical meniscus vibration in nozzle 10*c* from which ink is ejected, as seen in FIG. 12. Letting ejection times on ejections of the first drop, second drop, and third drop be $st_1$, $st_2$, $st_3$, respectively, and movements of hypothetical meniscus displacements be a1, a2, and a3, respectively, the relationship among them is defined as follows:

$$a1/st_1 \approx a2/st_2 \approx a3/st_3$$

By defining the hypothetical meniscus vibration so that a ratio between the ink ejection time and amount of the hypothetical meniscus displacement is to be constant, ink droplets having different volumes can be ejected at nearly the same velocities.

In addition to the above, displacements $X_1$, $X_2$, $X_4$, and $X_5$ of the hypothetical meniscus vibrations in nozzles 10*a*, 10*b*, 10*d*, and 10*e* adjacent nozzle 10*c* are set to −⅓ of displacement of hypothetical meniscus vibration, $X_3$, in nozzle 10*c*. By setting the hypothetical meniscus vibrations in this way, meniscus vibrations produced in nozzles 10*b* and 10*d* associated with ink ejection from nozzle 10*c* are made deconcentrated towards nozzles 10*a* and 10*e*, and thereby the amplitudes of meniscus vibrations in nozzles 10*b* and 10*d* are suppressed. As a result, protrusions of the meniscuses in nozzles 10*b* and 10*d* are alleviated and variation in velocity and volume among ink droplets ejected from nozzles 10*b* and 10*d* can be reduced.

In nozzle 10*e* that is disposed in the middle of ink-ejecting nozzle 10*c* and non ink-ejecting nozzle 10*g*, displacement X5 of hypothetical meniscus vibration in the case where ink is made not to be ejected from nozzle 10*g* (FIG. 12) is set so as to conform to displacement of hypothetical meniscus vibration, $X_5$, in the case where ink is made to be ejected from nozzle 10*g* (FIG. 18). Thereby, pressure vibration within pressure chamber 9*e* wherein ink is made not to be ejected from nozzle 10*g* can be equalized. This means that deflection of actuator 14*f* when ink is made not to be ejected from nozzle 10*g* can be made so as to become equal to deflection of actuator 14*f* when ink is made to be ejected.

In this way, by making the amplitude of deflection of actuator 14*f* constant whether ink is caused to be or not to be ejected from nozzle 10*g*, pressure vibration within pressure chamber 9*c* from which ink ejection is to be made can be made constant, and thus velocities and volumes of ink droplets ejected from pressure chamber 9*c* can be made constant. That is, deterioration of recording quality due to cross talk between chambers can thus be prevented.

Furthermore, in this embodiment, a ratio of the amplitudes of hypothetical meniscus displacements $X_6$-$X_8$ in three nozzles 10*f*-10*h* closely disposed with the center on ink-ejecting nozzle 10*g* to the amplitude of hypothetical meniscus displacement in nozzle 10*c* from which ink is to be ejected is set to ⅓. By this ratio of amplitudes of the displacements, pressure vibration in pressure chamber 9*f* associated with deflection of actuator 14*f* can be uniformly deconcentrated. This pressure deconcentration reduces the pressure vibrations produced in pressure chambers 9*f* and 9*h* to a minimal level and prevents accidental ejection of ink from nozzles 10*f*-10*h*.

By thus defining the meniscus vibrations and calculating back drive signals from this meniscus vibrations and response characteristics of the ink jet recording head, the drive signals for channels relative to nozzles 10*a*-10*h*, W1-W5 as shown in FIG. 17, are obtained. Drive signals W4 and W5 among them become ones that make deflection of actuator 14*f* constant whether ink is made to be or not to be ejected from nozzle 10*g*.

Figure 19:
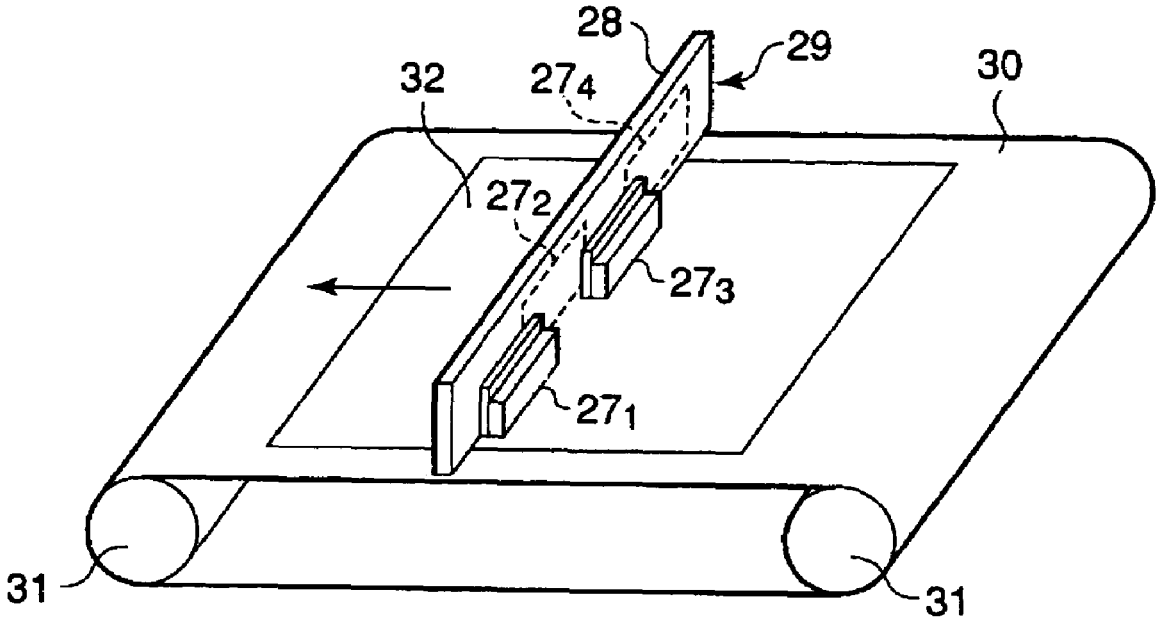
FIG. 19 is a perspective view illustrating appearance of principal parts of an ink jet recording apparatus according to the embodiment.

FIG. 19 is a perspective view illustrating an exterior of the principle part of the ink jet recording apparatus to whose recording head the above-mentioned control method is implemented. This ink jet recording apparatus incorporates a line head 29 in which, for example, four recording heads $\mathbf{27}_1$, $\mathbf{27}_2$, $\mathbf{27}_3$, and $\mathbf{27}_4$ are disposed on the both sides of substrate 28 in staggered fashion.

Line head 29 is installed with a predetermined gap from a medium conveying belt 30. Medium conveying belt 30, which is driven by a belt drive roller 31 in an arrow direction, conveys a recording medium 32 such as a paper in contact with the surface of the belt. Printing is made such that, when recording medium 32 passes under line head 29, ink droplets are caused to be ejected from the respective recording head $\mathbf{27}_1$-$\mathbf{27}_4$ downwards and deposited on recording medium 32. To attract and keep in contact recording medium 32 to medium conveying belt 30, a known method, such as one that causes to suck the recording medium using static electricity or air flow, or one that presses ends of the recording medium can be used.

Recording by the respective recording head is made in a line on the recording medium by adjusting timing of ejecting ink droplets from nozzles of the pressure chambers in the respective ink jet recording heads $\mathbf{27}_1$-$\mathbf{27}_4$ of the line head 29.

Also, in this embodiment, the drive circuit was configured such that drive signal waveform memory 21 was provided for storing waveform information relative to drive signals ACT1-ACT4 that are applied to ink-ejecting pressure chamber 9 and waveform information relative to drive signals INA1-INA4 that are to be applied to non-ink-ejecting pressure chamber, and these drive signals are read from drive signal waveform memory 21 and selected by drive signal selecting means 24. The structure need not be limited to such a scheme.

Figure 20:
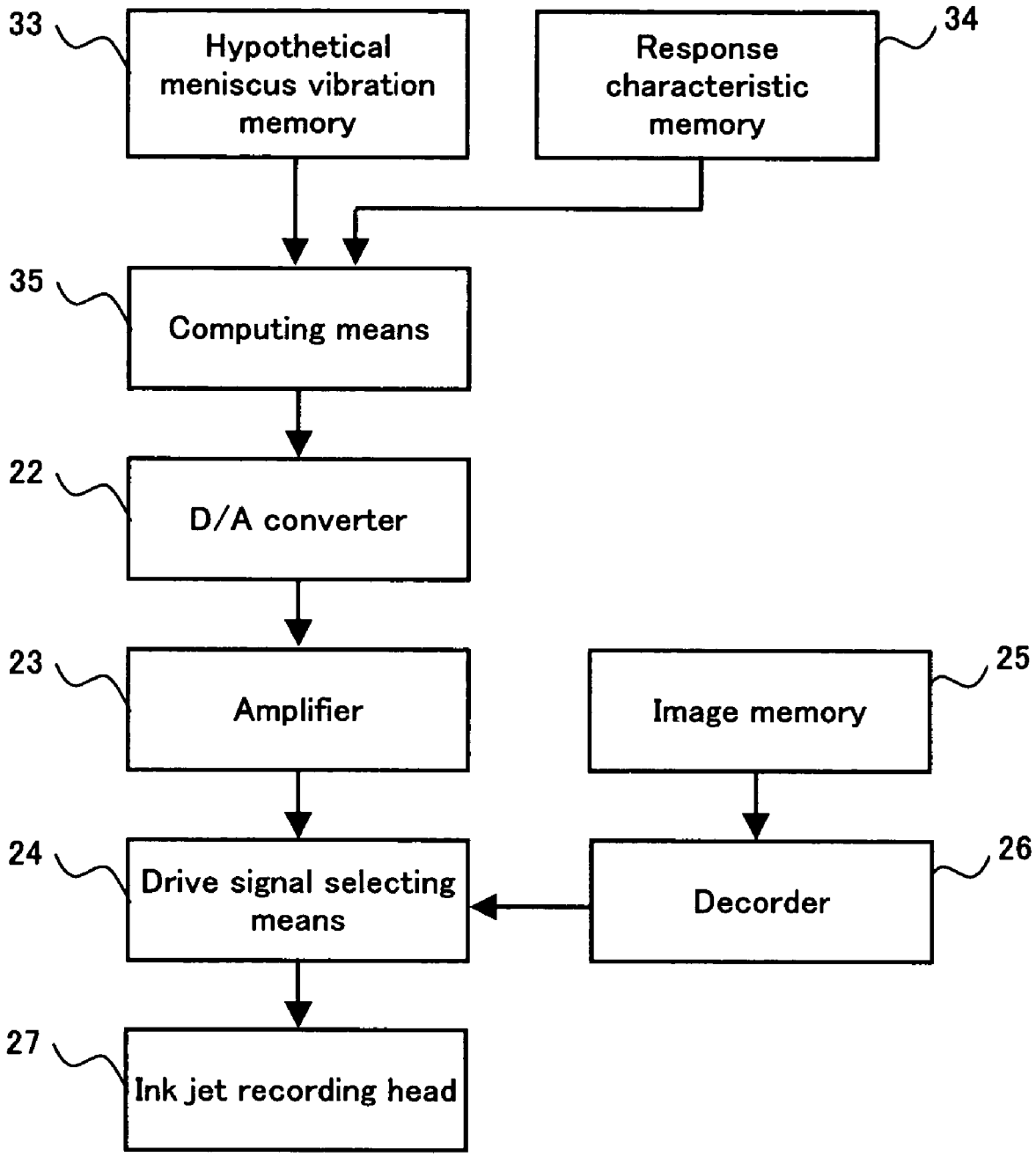
FIG. 20 is a functional block diagram of a drive circuit of an ink jet recording head according to another embodiment of the present invention.

Alternatively, for example, an ink jet recording apparatus as illustrated in FIG. 20 can be contemplated, which comprises hypothetical meniscus vibration memory 33 for storing information on hypothetical meniscus vibrations, response characteristic memory 34 for storing information on response characteristic R, and computing means 35. In this ink jet recording apparatus, control for ink ejection can be made such that computing means 35 computes a hypothetical meniscus flow velocity U from a displacement of the hypothetical meniscus vibration in hypothetical meniscus vibration memory 33, a flow velocity spectrum FU from this hypothetical meniscus flow velocity U, a voltage spectrum FVA from this flow velocity spectrum FU and response characteristic R stored in response characteristic memory 34; drive signals W1, W2, W3, W4, and W5 are obtained by computing formulas (10) and (11), then drive signals ACT1-ACT4 and INA1-INA4 are obtained from the resulted drive signals; lastly, these drive signals ACT1-ACT4 and INA1-INA4 are selected by drive signal selecting means 24.

To simplify such computations, it is desirable that, either the frequency response of the voltage waveform VA at more than f max be cut in computing means 35, or the frequency response of the hypothetical meniscus vibration at more than f max stored in hypothetical meniscus vibration memory 33 or the response characteristic at more than f max stored in response characteristic memory 34 be cut off prior to performing the computation.

In the embodiment in the above, the operations have been described using the four time-divisional drive method. However, the drive method need not be restricted to this. The procedures described above can be easily applied in six time-divisional drive method as well, and it is apparent that the cross talk between the pressure chambers that likely occurs in six time-divisional drive method can also be reduced to a substantially negligible level. This method is also applicable to eight or more even-numbered time divisional drive method as well.

Numerous modifications and variations of the present invention are possible in light of the above teachings. It is therefore to be understood that, within the scope of the appended claims, the present invention can be practiced in a manner other than as specifically described therein.

What is claimed is:

1. An ink jet recording apparatus comprising:

an ink jet recording head having a plurality of nozzles from each of which ink is ejected, a plurality of pressure chambers communicating with the respective nozzles, ink supplying means for supplying ink to the respective pressure chambers, a plurality of electrodes provided relative to the respective pressure chambers, and actuators each of which forms a side wall isolating the respective pressure chambers and is caused to deflect so as to vary a volume of the pressure chamber from which ink is to be ejected according to drive signals that are applied between one electrode relative to a pressure chamber from which ink is ejected and the electrodes relative to the two pressure chambers adjacent to the former; and drive signal generating means for generating drive signals that enables time-divisional driving so that ink droplets are concurrently ejected from every N pressure chambers, where N=2M (M≧2), and supplying the drive signals to electrodes relative to the respective pressure chambers, wherein said drive signal generating means supplies to an electrode relative to at least outmost pressure chamber among (N−1) pressure chambers closely disposed with the center on a pressure chamber from which ink is made not to be ejected at a timing when the ink ejection is enabled, such a drive signal that makes a magnitude of deflection of an outmost actuator among N actuators close around a pressure chamber from which ink is made not to be ejected at a timing when the ink ejection is enabled in the time-divisional driving operation substantially conform to a magnitude of deflection of an outmost actuator (or actuators) among N actuators disposed close around a pressure chamber from which ink is made to be ejected.

2. An ink jet recording apparatus according to claim 1, wherein said drive signal supplied to the electrode relative to the outmost pressure chamber is a waveform that is obtained as a result of computation based on a response characteristic of a meniscus vibration within a nozzle produced in response to a voltage signal.

3. An ink jet recording apparatus according to claim 2, wherein said computation based on the response characteristic includes a process of computing a voltage vector {FVA} by $[R]^{-1}\cdot\{FU\}$ and subsequent Fourier inverse transforming of the voltage vector {FVA}, where a vector of hypothetical meniscus flow velocities in a plurality of nozzles is defined as {U}, a flow velocity vector as the result of the Fourier transform of the vector {U} as {FU}, and a matrix of a response characteristic of the meniscus flow velocities in the respective nozzles in response to the drive signal as {R}.

4. An ink jet recording apparatus according to claim 3, wherein in said computation based on the response characteristic, a frequency component at or more than a predetermined frequency is cut off.

5. An ink jet recording apparatus according to claim 1, wherein said drive signal generating means supplies the drive signal such that pressure vibrations of (N−1) pressure chambers closely disposed with the center on the pressure chamber from which ink is made not to be ejected at a timing when the ink ejection is enabled can be evenly deconcentrated.

* * * * *